US011810503B2

(12) United States Patent
Kwon et al.

(10) Patent No.: US 11,810,503 B2
(45) Date of Patent: Nov. 7, 2023

(54) DISPLAY DEVICE FOR PERFORMING A CHARGE SHARING OPERATION

(71) Applicant: SAMSUNG ELECTRONICS CO., LTD., Suwon-si (KR)

(72) Inventors: Taeksu Kwon, Suwon-si (KR); Jihoon Kim, Busan (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/591,001

(22) Filed: Feb. 2, 2022

(65) Prior Publication Data

US 2022/0366842 A1 Nov. 17, 2022

(30) Foreign Application Priority Data

May 13, 2021 (KR) ..... 10-2021-0061887
Jun. 28, 2021 (KR) ..... 10-2021-0083625

(51) Int. Cl.
*G09G 3/3208* (2016.01)

(52) U.S. Cl.
CPC ... *G09G 3/3208* (2013.01); *G09G 2300/0452* (2013.01); *G09G 2310/0291* (2013.01); *G09G 2310/0297* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 9,280,945 | B2 | 3/2016 | Oh et al. | |
| 9,449,557 | B2 | 9/2016 | Kim | |
| 9,558,698 | B2 | 1/2017 | Chen et al. | |
| 2011/0069088 | A1 | 3/2011 | Weng et al. | |
| 2013/0257917 | A1* | 10/2013 | Peng | G09G 3/3688 345/690 |
| 2015/0015471 | A1* | 1/2015 | Zhu | G09G 3/3648 345/92 |

(Continued)

FOREIGN PATENT DOCUMENTS

| | | |
|---|---|---|
| KR | 1666578 | 10/2016 |
| KR | 1971447 | 8/2019 |
| KR | 10-2020-0020191 | 2/2020 |

*Primary Examiner* — Roberto W Flores
*Assistant Examiner* — Donna V Bocar
(74) *Attorney, Agent, or Firm* — F. Chau & Associates, LLC

(57) ABSTRACT

A display device including: a display panel including first and second data lines, a first and second pixels connected to first and second data lines in first pixel row, third and fourth pixels connected to the second data line in a second pixel row; and a display driver configured to receive image data including first, second, third and fourth pixel data for the first, second, third and fourth pixels, and provide first, second, third and fourth data voltages corresponding to the first, second, third and fourth pixel data to the first, second, third and fourth pixels through the first and second data lines, the display driver further configured to: calculate average data of the first and second pixel data; and selectively perform a charge sharing operation between the first and second data lines according to whether a first increase/decrease condition and a second increase/decrease condition are satisfied.

20 Claims, 22 Drawing Sheets

(56) References Cited

U.S. PATENT DOCUMENTS

| | | | | |
|---|---|---|---|---|
| 2015/0103065 | A1 | 4/2015 | Kim et al. | |
| 2016/0071455 | A1* | 3/2016 | Jung | G09G 3/20 345/209 |
| 2016/0078835 | A1* | 3/2016 | Cho | G09G 3/3696 345/212 |
| 2016/0180776 | A1* | 6/2016 | Cho | G09G 3/20 345/215 |
| 2019/0259330 | A1* | 8/2019 | Lee | G09G 3/3258 |
| 2021/0174722 | A1* | 6/2021 | Choi | G09G 3/20 |
| 2022/0262320 | A1* | 8/2022 | Chang | G09G 3/3291 |

* cited by examiner

DISPLAY DEVICE FOR PERFORMING A CHARGE SHARING OPERATION

CROSS-REFERENCE TO RELATED APPLICATIONS

This application claims priority under 35 U.S.C. § 119 to Korean Patent Application No. 10-2021-0061887 filed on May 13, 2021 and to Korean Patent Application No. 10-2021-0083625 filed on Jun. 28, 2021 in the Korean Intellectual Property Office (KIPO), the disclosures of which are incorporated by reference herein in their entireties.

1. TECHNICAL FIELD

Example embodiments of the present disclosure relate generally to semiconductor integrated circuits, and more particularly to a display device including a display driver for performing a charge sharing operation.

2. DISCUSSION OF THE RELATED ART

An electroluminescent display is a type of flat panel display created by sandwiching a layer of electroluminescent material between two layers of conductors. The electroluminescent display may have a fast response speed and low power consumption compared with other types of displays. This improved performance may be achieved, at least in part, through the use of pixels that use light emitting diodes or organic light-emitting diodes (OLEDs). However, as a resolution of a display panel increases, and/or as an operating frequency of a display panel increases, power consumption of a display driver and electroluminescent display may be increased.

To reduce the power consumption of the display driver and the electroluminescent display, a charge sharing technique has been developed. In the charge sharing technique, voltages of data lines of the electroluminescent display are changed by connecting the data lines to each other before data voltages are applied to the data lines.

SUMMARY

Some example embodiments of the present disclosure may provide a display device capable of reducing power consumption.

According to example embodiments of the present disclosure, there is provided a display device including: a display panel including a first data line, a second data line, a first pixel in a first pixel row and connected to the first data line, a second pixel in the first pixel row and connected to the second data line, a third pixel in a second pixel row and connected to the first data line and a fourth pixel in the second pixel row and connected to the second data line, wherein the second pixel row is adjacent to the first pixel row; and a display driver configured to receive image data including first, second, third and fourth pixel data for the first, second, third and fourth pixels, respectively, and to provide first, second, third and fourth data voltages respectively corresponding to the first, second, third and fourth pixel data to the first, second, third and fourth pixels through the first and second data lines, the display driver further configured to: calculate average data of the first pixel data and the second pixel data; and selectively perform a charge sharing operation between the first data line and the second data line according to whether a first increase/decrease condition among the first pixel data, the average data and the third pixel data and a second increase/decrease condition among the second pixel data, the average data and the fourth pixel data are satisfied.

According to example embodiments of the present disclosure, there is provided a display device including: a display panel including a first data line, a second data line, a first pixel in a first pixel row and connected to the first data line, a second pixel in the first pixel row and connected to the second data line, a third pixel in a second pixel row and connected to the first data line and a fourth pixel in the second pixel row and connected to the second data line, wherein the second pixel row is adjacent to the first pixel row; a display driver configured to receive image data including first, second, third and fourth pixel data for the first, second, third and fourth pixels, respectively, and including an output buffer circuit configured to provide first, second, third and fourth data voltages respectively corresponding to the first, second, third and fourth pixel data to the first and second data lines; and a multiplexer configured to selectively connect the output buffer circuit to the first data line or the second data line, wherein the display driver is further configured to: calculate average data of the first pixel data and the second pixel data; and selectively perform a charge sharing operation between the first data line and the second data line by using the multiplexer according to whether a first increase/decrease condition among the first pixel data, the average data and the third pixel data and a second increase/decrease condition among the second pixel data, the average data and the fourth pixel data are satisfied.

According to example embodiments of the present disclosure, there is provided a display device including: a display panel including a first data line, a second data line, a first pixel in a first pixel row and connected to the first data line, a second pixel in the first pixel row and connected to the second data line, a third pixel in a second pixel row and connected to the first data line and a fourth pixel in the second pixel row and connected to the second data line, wherein the second pixel row is adjacent to the first pixel row; and a display driver configured to receive image data including first, second, third and fourth pixel data for the first, second, third and fourth pixels, respectively, and to provide first, second, third and fourth data voltages respectively corresponding to the first, second, third and fourth pixel data to the first, second, third and fourth pixels through the first and second data lines, the display driver including: an output buffer circuit configured to output the first, second, third and fourth data voltages; an output switch circuit configured to selectively connect the output buffer circuit to the first and second data lines in response to an output enable signal; and a charge sharing switch circuit configured to selectively connect the first and second data lines to each other in response to a charge sharing control signal, wherein the display driver is further configured to: determine a difference condition in which differences among the first, second, third and fourth pixel data are greater than or equal to a first reference difference; calculate average data of the first pixel data and the second pixel data; determine a first increase/decrease condition among the first pixel data, the average data and the third pixel data and a second increase/decrease condition among the second pixel data, the average data and the fourth pixel data; and perform a charge sharing operation between the first data line and the second data line when the difference condition, the first increase/decrease condition and the second increase/decrease condition are satisfied.

The display device according to example embodiments of the present disclosure may calculate average data of first pixel data and second pixel data, and may selectively perform a charge sharing operation according to whether a first increase/decrease condition among the first pixel data, the average data and third pixel data and a second increase/decrease condition among the second pixel data, the average data and fourth pixel data are satisfied. Accordingly, in the display device according to example embodiments of the present disclosure, the charge sharing operation may be performed only in a case where power consumption is reduced by the charge sharing operation. Further, in the display device according to example embodiments of the present disclosure, the number of the charge sharing operations may be increased.

BRIEF DESCRIPTION OF THE DRAWINGS

Example embodiments of the present disclosure will be more clearly understood from the following detailed description taken in conjunction with the accompanying drawings.

DETAILED DESCRIPTION OF THE EMBODIMENTS

Various example embodiments of the present disclosure will be described more fully hereinafter with reference to the accompanying drawings. The present disclosure may, however, be embodied in many different forms and should not be construed as limited to the embodiments set forth herein. Like numerals may refer to like elements throughout the drawings. Repeated descriptions of the elements disclosed herein may be omitted.

Figure 1:
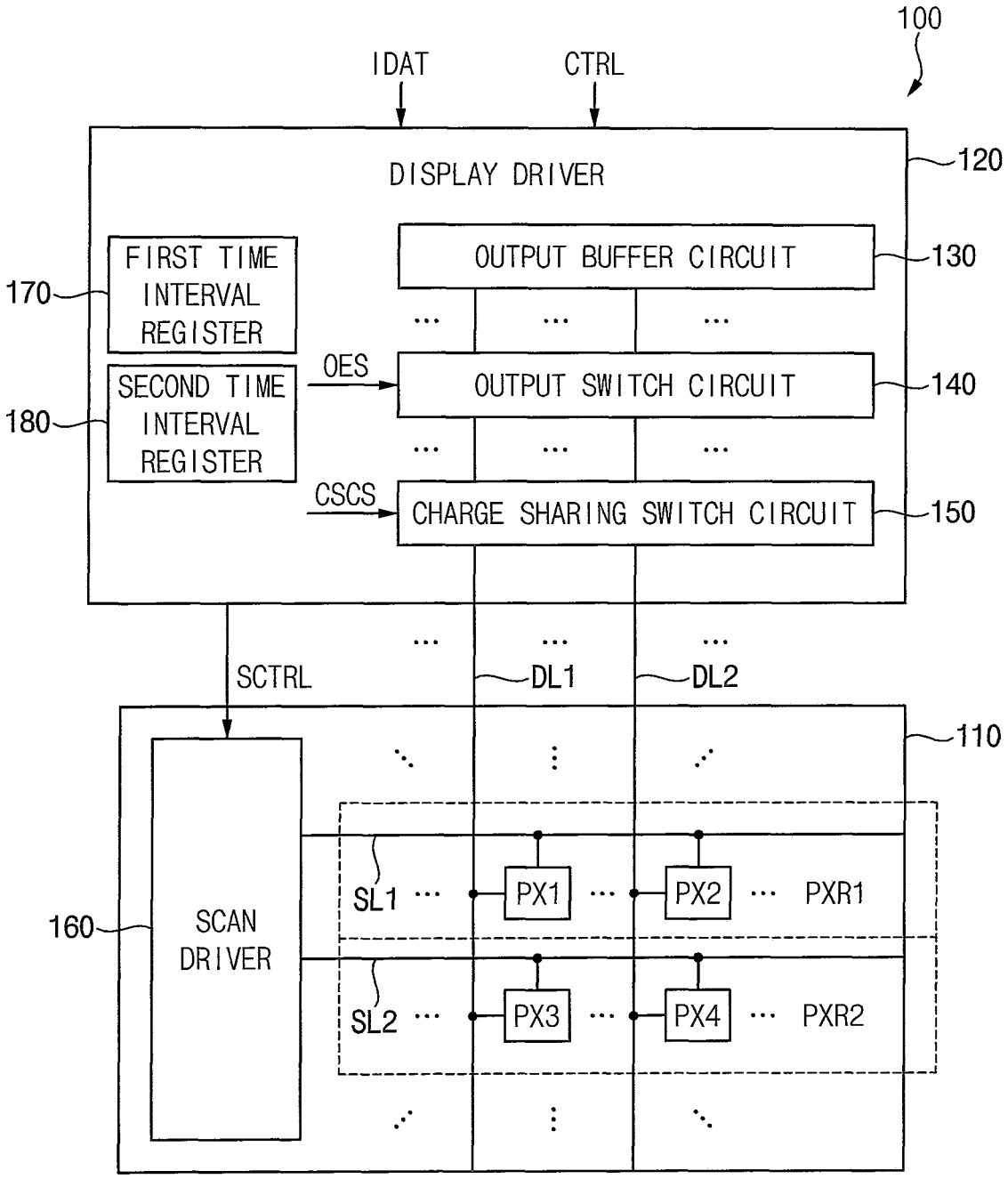
FIG. 1 is a block diagram illustrating a display device according to example embodiments of the present disclosure.
Figure 2:
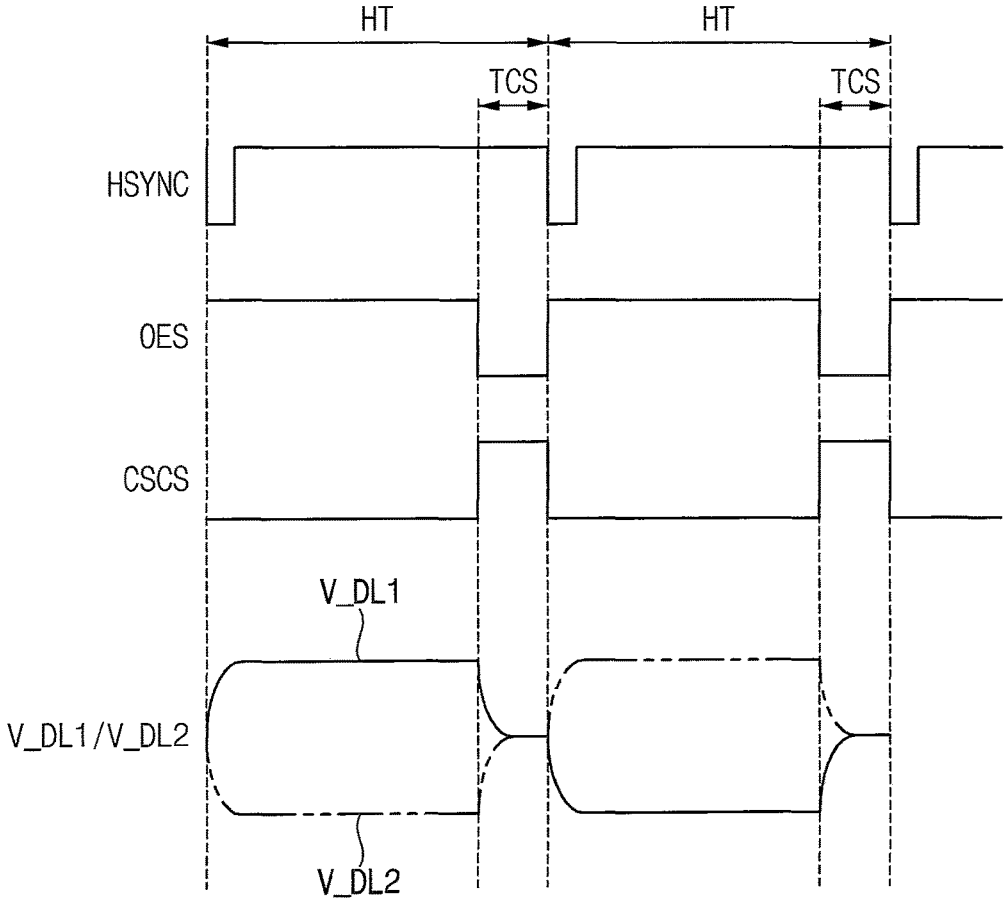
FIG. 2 is a timing diagram for describing an example of a charge sharing operation performed by a display device according to example embodiments of the present disclosure.
Figure 3:
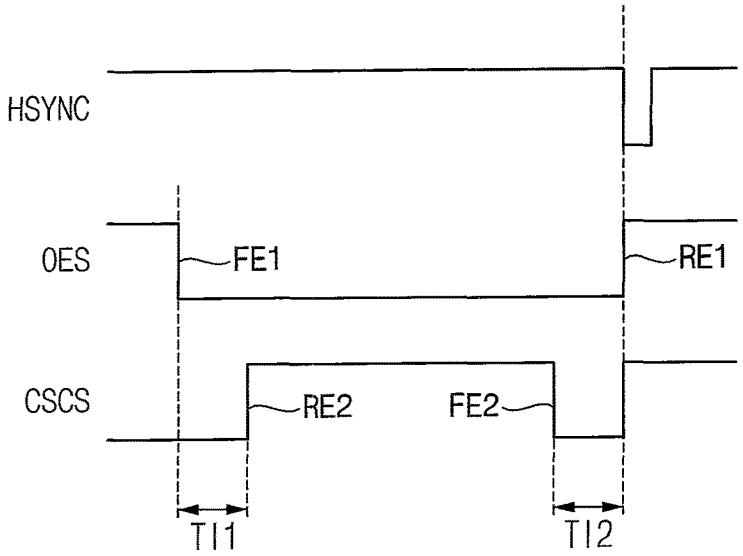
FIG. 3 is a timing diagram for describing an example of a relationship between an output enable signal and a charge sharing control signal.

FIG. 1 is a block diagram illustrating a display device according to example embodiments of the present disclosure, FIG. 2 is a timing diagram for describing an example of a charge sharing operation performed by a display device according to example embodiments of the present disclosure, and FIG. 3 is a timing diagram for describing an example of a relationship between an output enable signal and a charge sharing control signal.

Referring to FIG. 1, a display device 100 may include a display panel 110, and a display driver 120 that drives thXe display panel 110. In some example embodiments of the present disclosure, the display device 100 may further include a scan driver 160 formed on the display panel 110.

The display panel 110 may include a plurality of data lines DL1 and DL2, a plurality of scan lines SL1 and SL2, and a plurality of pixels PX1, PX2, PX3 and PX4 connected to the plurality of data lines DL1 and DL2 and the plurality of scan lines SL1 and SL2. For example, the display panel 110 may include a first pixel PX1 connected to a first data line DL1 and a second pixel PX2 connected to a second data line DL2 in a first pixel row PXR1 (e.g., a row of the first and second pixels PX1 and PX2 connected to a first scan line SL1). The display panel 110 may further include a third pixel PX3 connected to the first data line DL1 and a fourth pixel PX4 connected to the second data line DL2 in a second pixel row PXR2 (e.g., a row of the second and third pixels PX3 and PX4 connected to a second scan line SL2) adjacent to the first pixel row PXR1.

The display driver 120 may receive image data IDAT and control signal CTRL from an external host processor (e.g., an application processor (AP), a graphics processing unit (GPU) or a graphic card). The image data IDAT may include a plurality of pixel data for the plurality of pixels PX1, PX2, PX3 and PX4. For example, the image data IDAT may include first, second, third and fourth pixel data for the first, second, third and fourth pixels PX1, PX2, PX3 and PX4. In some example embodiments of the present disclosure, the control signal CTRL may include, but is not limited to, a vertical synchronization signal, a horizontal synchronization signal, an input data enable signal and a master clock signal.

The display driver 120 may generate a scan control signal SCTRL for controlling the scan driver 160 based on the control signal CTRL. In some example embodiments of the present disclosure, the scan control signal SCTRL may include, but is not limited to, a scan start signal and a scan clock signal. The scan driver 160 may sequentially provide scan signals to plurality of pixels PX1, PX2, PX3 and PX4 on a row-by-row basis through the plurality of scan lines SL1 and SL2. The display driver 120 may provide data voltages corresponding to the image data IDAT to the plurality of pixels PX1, PX2, PX3 and PX4 through the plurality of data lines DL1 and DL2 based on the image data IDAT and the control signal CTRL. For example, the display driver 120 may provide first, second, third and fourth data voltages corresponding to the first, second, third and fourth pixel data to the first, second, third and fourth pixels PX1, PX2, PX3 and PX4 through the first and second data lines DL1 and DL2.

In some example embodiments of the present disclosure, the display driver 120 may be implemented with a single integrated circuit. In other example embodiments of the present disclosure, the display driver 120 may include a timing controller and one or more data drivers, and the timing controller and the data drivers may be implemented with separate integrated circuits.

In the display device 100 according to example embodiments of the present disclosure, to determine whether to perform a charge sharing operation between two data lines (e.g., the first and second data lines DL1 and DL2), the display driver 120 may calculate average data of the pixel data for the pixels (e.g., the first and second pixels PX1 and PX2) connected to the two data lines in a current pixel row (e.g., the first pixel row PXR1), and may determine increase/decrease conditions among the pixel data for the pixels in the current pixel row, the average data, and the pixel data for the pixels (e.g., the third and fourth pixels PX3 and PX4) in a next pixel row (e.g., the second pixel row PXR2). For example, the display driver 120 may calculate average data of the first pixel data for the first pixel PX1 and the second pixel data for the second pixel PX2, and may selectively perform the charge sharing operation between the first data line DL1 and the second data line DL2 according to whether a first increase/decrease condition among the first pixel data for the first pixel PX1, the average data and the third pixel data for the third pixel PX3 and a second increase/decrease condition among the second pixel data for the second pixel PX2, the average data and the fourth pixel data for the fourth pixel PX4 are satisfied. The display driver 120 may perform the charge sharing operation between the first data line DL1 and the second data line DL2 only when the first increase/decrease condition and the second increase/decrease condition are satisfied.

In some example embodiments of the present disclosure, the display driver 120 may determine not only the first increase/decrease condition and the second increase/decrease condition, but also a difference condition of whether differences among the first, second, third and fourth pixel data are greater than or equal to a first reference difference. The display driver 120 may perform the charge sharing operation when the difference condition, the first increase/decrease condition and the second increase/decrease condition are satisfied.

In other example embodiments of the present disclosure, the display driver 120 may further determine a white pattern condition of whether the first, second, third and fourth pixel data correspond to a white pattern. The display driver 120 may perform the charge sharing operation when the first increase/decrease condition and the second increase/decrease condition are satisfied or when the white pattern condition is satisfied.

In a case where the above described conditions (e.g., the first increase/decrease condition and the second increase/decrease condition) are satisfied, the display driver 120 may perform the charge sharing operation between the first and second data lines DL1 and DL2 after the first and second data voltages are output to the first and second data lines DL1 and DL2 and before the third and fourth data voltages are output to the first and second data lines DL1 and DL2. In some example embodiments of the present disclosure, to perform the charge sharing operation, the display driver 120 may include an output buffer circuit 130 that outputs the first, second, third and fourth data voltages, an output switch circuit 140 that selectively connects the output buffer circuit 130 to the first and second data lines DL1 and DL2 in response to an output enable signal OES, and a charge sharing switch circuit 150 that selectively connects the first and second data lines DL1 and DL2 to each other in response to a charge sharing control signal CSCS.

For example, as illustrated in FIG. 2, each horizontal time HT defined by a horizontal synchronization signal HSYNC may include a charge sharing time TCS during which the charge sharing operation is performed. In a case where the first increase/decrease condition and the second increase/decrease condition are satisfied, the display driver 120 may generate the output enable signal OES having a low level and the charge sharing control signal CSCS having a high level in the charge sharing time TCS, the output switch circuit 140 may disconnect the output buffer circuit 130 from the first and second data lines DL1 and DL2 in response to the output enable signal OES having the low level, and the charge sharing switch circuit 150 may connect the first and second data lines DL1 and DL2 to each other in response to the charge sharing control signal CSCS having the high level. If the first and second data lines DL1 and DL2 are connected to each other, or if the charge sharing operation between the first and second data lines DL1 and DL2 is performed, voltages V_DL1 and V_DL2 of the first and second data lines DL1 and DL2 may be changed to an intermediate voltage of current data voltages without power consumption (or with small power consumption). Thus, in a case where, compared with each of the current data voltages, the intermediate voltage is close to next data voltages, a dynamic current of the display driver 120 may be reduced when the next data voltages are output (compared with a case where the charge sharing operation is not performed), and power consumption of the display driver 120 and the display device 100 may be reduced.

In some example embodiments of the present disclosure, a period in which the charge sharing control signal CSCS has the high level and a period in which the output enable signal OES has a high level do not overlap each other. For example, as illustrated in FIG. 3, a rising edge RE2 of the charge sharing control signal CSCS may lag a falling edge FE1 of the output enable signal OES by a first time interval TI1, and a falling edge FE2 of the charge sharing control signal CSCS may lead a rising edge RE1 of the output enable signal OES by a second time interval TI2. In some example embodiments of the present disclosure, the display driver 120 may further include a first time interval register 170 that stores the first time interval TI1 between the rising edge RE2 of the charge sharing control signal CSCS and the falling edge FE1 of the output enable signal OES, and a second time interval register 180 that stores the second time interval TI2 between the falling edge FE2 of the charge sharing control signal CSCS and the rising edge RE1 of the output enable signal OES. The display driver 120 may generate the output enable signal OES and the charge sharing control signal CSCS to have the first and second time intervals TI1 and TI2 stored in the first and second time interval registers 170 and 180.

A conventional display device may determine whether to perform a charge sharing operation according to the number of pixel data of which most significant bits are changed between image data for a current pixel row and image data for a next pixel row. Further, in the conventional display device, the charge sharing operation may be performed with respect to all data lines, or the charge sharing operation may not be performed with respect to all data lines. Thus, in this conventional display device, the charge sharing operation may be performed between data lines where power consumption is not reduced by the charge sharing operation, or may not be performed between data lines where power consumption is reduced by the charge sharing operation.

However, the display device 100 according to example embodiments of the present disclosure may calculate the average data of the first pixel data and the second pixel data, and may selectively perform the charge sharing operation between the first and second data lines DL1 and DL2 according to whether the first increase/decrease condition among the first pixel data, the average data and the third pixel data and the second increase/decrease condition among the second pixel data, the average data and the fourth pixel data are satisfied. Accordingly, in the display device 100 according to example embodiments of the present disclosure, since the charge sharing operation is performed between the data lines where the first and second increase/decrease conditions are satisfied, the charge sharing operation may be performed only in a case where power consumption is reduced by the charge sharing operation. Further, in the display device 100 according to example embodiments of the present disclosure, as opposed to the conventional display device that performs the charge sharing operation with respect to all of the data lines, the charge sharing operation may be selectively performed between each pair of the data lines DL1 and DL2 or each pair or data channels. Accordingly, in the display device 100 according to example embodiments of the present disclosure, the number of the charge sharing operations may be increased.

Figure 4:
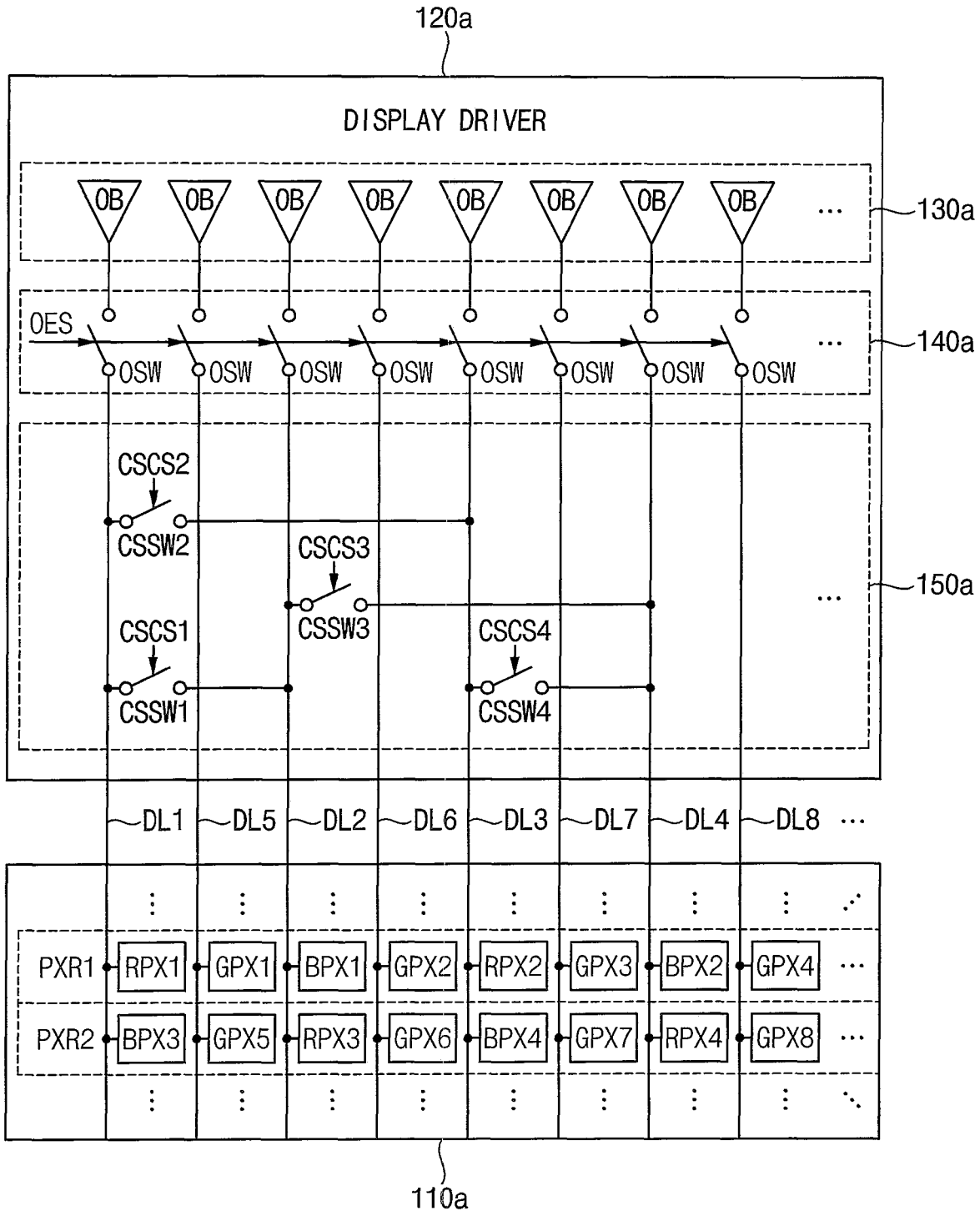
FIG. 4 is a block diagram illustrating a display device including a display panel having an RGBG pixel arrangement structure according to example embodiments of the present disclosure.
Figure 5:
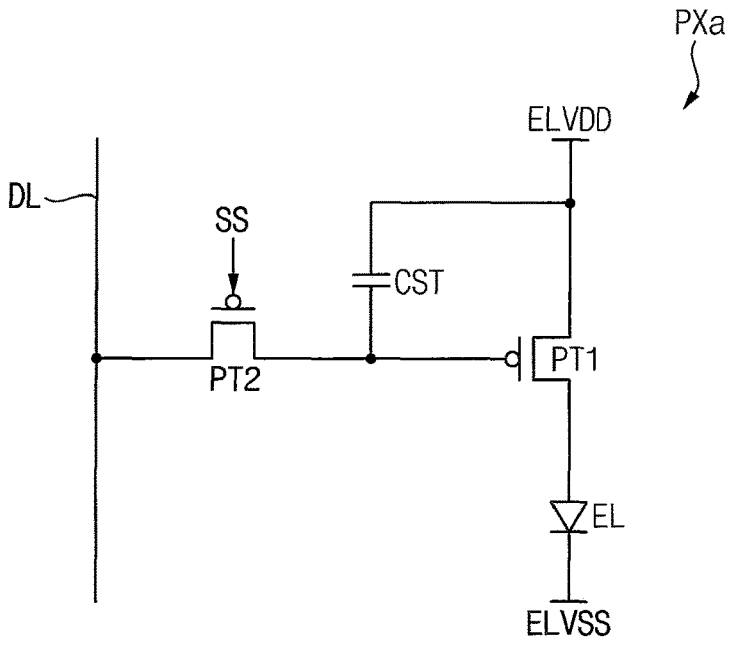
FIG. 5 is a circuit diagram illustrating an example of a pixel included in a display device according to example embodiments of the present disclosure.
Figure 6:
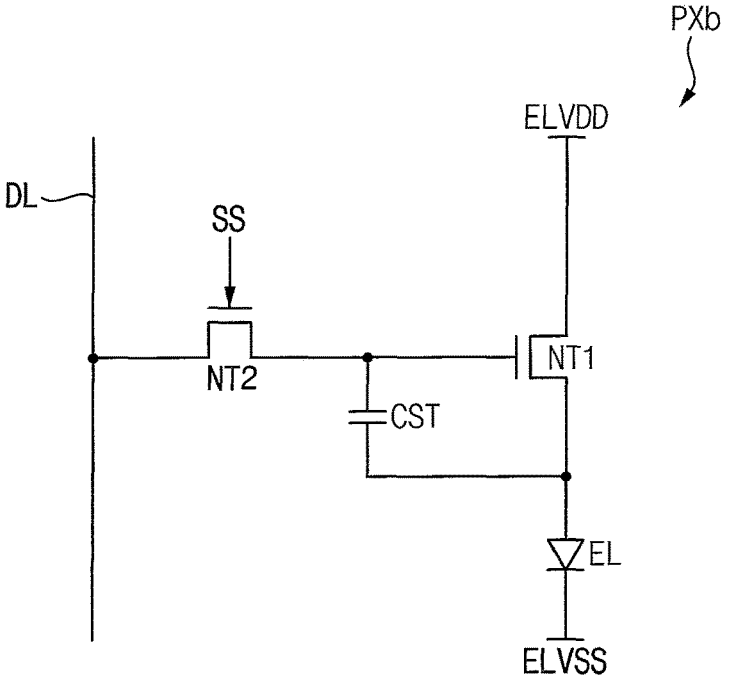
FIG. 6 is a circuit diagram illustrating another example of a pixel included in a display device according to example embodiments of the present disclosure.

FIG. 4 is a block diagram illustrating a display device including a display panel having an RGBG pixel arrangement structure according to example embodiments of the present disclosure, FIG. 5 is a circuit diagram illustrating an example of a pixel included in a display device according to example embodiments of the present disclosure, and FIG. 6 is a circuit diagram illustrating another example of a pixel included in a display device according to example embodiments of the present disclosure.

Referring to FIG. 4, a display panel 110*a* may have an RGBG pixel arrangement structure where a red pixel, a green pixel, a blue pixel and a green pixel are repeatedly arranged in an odd-numbered pixel row, and a blue pixel, a green pixel, a red pixel and a green pixel are repeatedly arranged in an even-numbered pixel row. In some example embodiments of the present disclosure, the RGBG pixel arrangement structure may be referred to as an RGBG PENTILE™ structure. For example, in the display panel 110*a*, a first red pixel RPX1, a first green pixel GPX1, a first blue pixel BPX1, a second green pixel GPX2, a second red pixel RPX2, a third green pixel GPX3, a second blue pixel BPX2 and a fourth green pixel GPX4 may be repeatedly arranged in a first pixel row PXR1, and a third blue pixel BPX3, a fifth green pixel GPX5, a third red pixel RPX3, a sixth green pixel GPX6, a fourth blue pixel BPX4, a seventh green pixel GPX7, a fourth red pixel RPX4 and an eighth green pixel GPX8 may be repeatedly arranged in a second pixel row PXR2.

In some example embodiments of the present disclosure, each of the red, green and blue pixels may include a driving transistor implemented with a p-type metal-oxide-semiconductor (PMOS) transistor. For example, as illustrated in FIG. 5, each pixel PXa may include a scan transistor PT2 that transfers a data voltage of a data line DL in response to a scan signal SS, a storage capacitor CST that stores the data voltage transferred by the scan transistor PT2, a driving transistor PT1 that generates a driving current based on the data voltage stored in the storage capacitor CST, and an organic light emitting diode EL that emits light based on the driving current flowing from a line of a high power supply voltage ELVDD to a line of a low power supply voltage ELVSS. In FIG. 5, the storage capacitor Cst may be connected between a gate of the driving transistor PT1 and the high power supply voltage ELVDD. In a case where the driving transistor PT1 is implemented with a PMOS transistor as illustrated in FIG. 5, a voltage level of the data voltage may decrease as a gray level of pixel data increases.

In other example embodiments of the present disclosure, each of the red, green and blue pixels may include a driving transistor implemented with an n-type metal-oxide-semiconductor (NMOS) transistor. For example, as illustrated in FIG. 6, each pixel PXb may include a scan transistor NT2 that transfers a data voltage of a data line DL in response to a scan signal SS, a storage capacitor CST that stores the data voltage transferred by the scan transistor NT2, a driving transistor NT1 that generates a driving current based on the data voltage stored in the storage capacitor CST, and an organic light emitting diode EL that emits light based on the driving current flowing from a line of a high power supply voltage ELVDD to a line of a low power supply voltage ELVSS. In FIG. 6, the storage capacitor Cst may be connected between a gate of the driving transistor PT1 and an anode of the organic light emitting diode EL. In a case where the driving transistor NT1 is implemented with an NMOS transistor as illustrated in FIG. 6, a voltage level of the data voltage may increase as a gray level of pixel data increases.

Although FIGS. 5 and 6 illustrate examples of the pixel PXa and PXb having a 2T1C pixel structure including two transistors and one capacitor, a structure of the pixel PXa and PXb according to example embodiments of the present disclosure is not limited to the examples of FIGS. 5 and 6.

The display panel 110*a* may include a plurality of data lines DL1 through DL8. For example, the display panel 110*a* may include a first data line DL1 connected to the first red pixel RPX1 and the third blue pixel BPX3, a second data line DL2 connected to the first blue pixel BPX1 and the third red pixel RPX3, a third data line DL3 connected to the second red pixel RPX2 and the fourth blue pixel BPX4, a fourth data line DL4 connected to the second blue pixel BPX2 and the fourth red pixel RPX4, a fifth data line DL5 connected to the first green pixel GPX1 and the fifth green pixel GPX5, a sixth data line DL6 connected to the second green pixel GPX2 and the sixth green pixel GPX6, a seventh data line DL7 connected to the third green pixel GPX3 and the seventh green pixel GPX7, and an eighth data line DL8 connected to the fourth green pixel GPX4 and the eighth green pixel GPX8. For example, odd-numbered data lines may be connected to the green pixels GPX1 to GPX8.

An output buffer circuit 130*a* of a display driver 120*a* may include a plurality of output buffers OB that respectively output a plurality of data voltages, and an output switch circuit 140*a* of the display driver 120*a* may include a plurality of output switches OSW that selectively connect the plurality of output buffers OB of the output buffer circuit 130*a* to the plurality of data lines DL1 through DL8 in response to an output enable signal OES. A charge sharing switch circuit 150*a* of the display driver 120*a* may include a plurality of charge sharing switches CSSW1, CSSW2, CSSW3 and CSSW4 that connect the data lines DL1, DL2, DL3 and DL4 to each other in response to a plurality of charge sharing control signals CSCS1, CSCS2, CSCS3 and CSCS4.

In some example embodiments of the present disclosure, as illustrated in FIG. 4, no charge sharing switch is disposed between the data lines DL5 through DL8 connected to the green pixels GPX1 through GPX8, and the charge sharing switches CSSW1 through CSSW4 may be disposed between the data lines DL1 through DL4 connected to the red and blue pixels RPX1 through RPX4 and BPX1 through BPX4. For example, the charge sharing switch circuit 150*a* may include a first charge sharing switch CSSW1 that selectively connects the first data line DL1 and the second data line DL2 in response to a first charge sharing control signal CSCS1, a second charge sharing switch CSSW2 that selectively connects the first data line DL1 and the third data line DL3 in response to a second charge sharing control signal CSCS2, a third charge sharing switch CSSW3 that selectively connects the second data line DL2 and the fourth data line DL4 in response to a third charge sharing control signal CSCS3, and a fourth charge sharing switch CSSW4 that selectively connects the third data line DL3 and the fourth data line DL4 in response to a fourth charge sharing control signal CSCS4.

Since a difference between pixel data for adjacent green pixels GPX1 through GPX8 may be less than a reference difference, a charge sharing operation between the data lines DL5 through DL8 connected to the green pixels GPX1 through GPX8 may not be necessary. Accordingly, in a display device according to example embodiments of the present disclosure, the charge sharing switch circuit 150*a* may not include a charge sharing switch between the data lines DL5 through DL8 connected to the green pixels GPX1 through GPX8, and thus a size of the charge sharing switch circuit 150*a* and the display driver 120*a* may be reduced.

Figure 7:
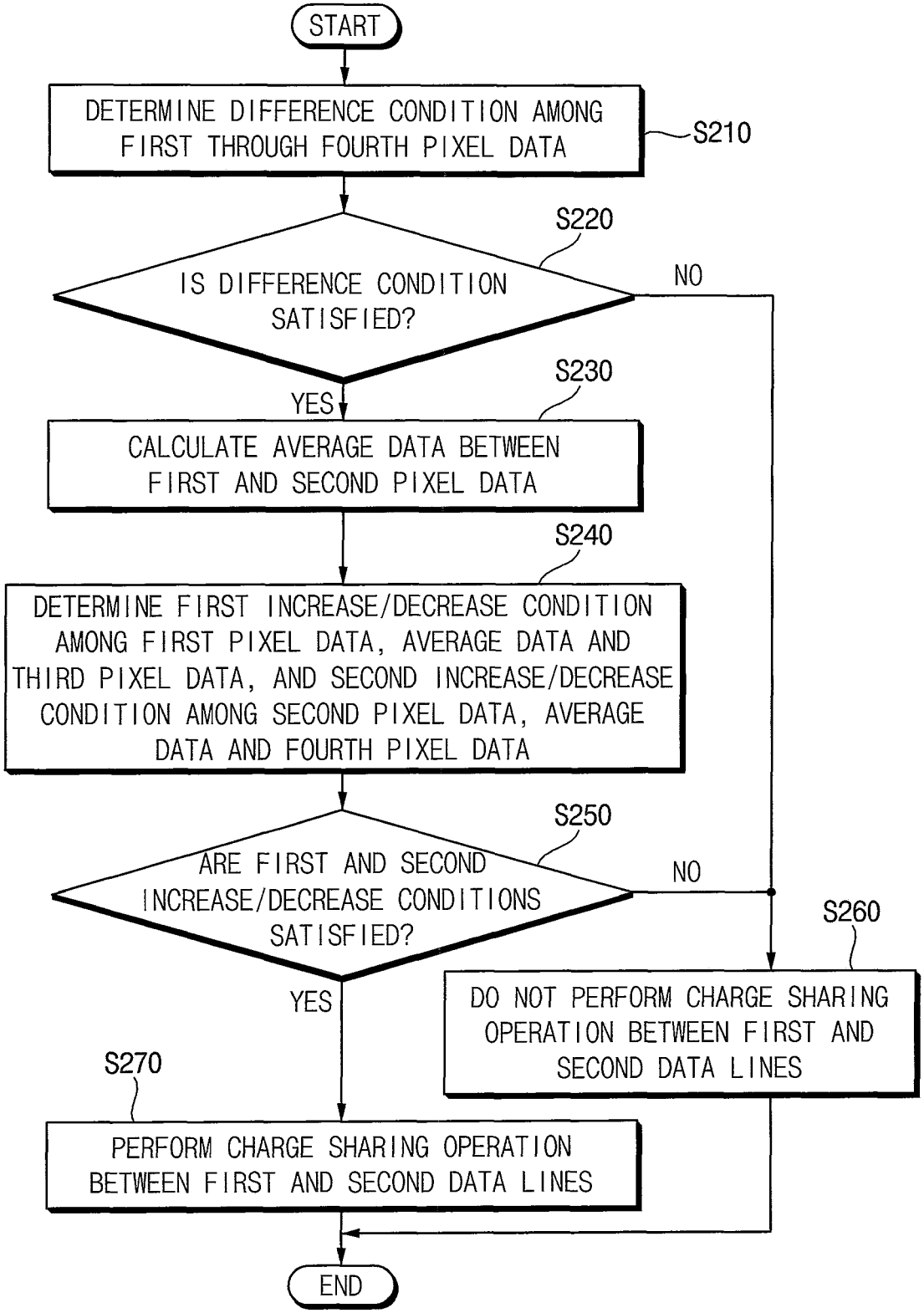
FIG. 7 is a flow chart illustrating a method of performing a charge sharing operation according to example embodiments of the present disclosure.
Figure 8:
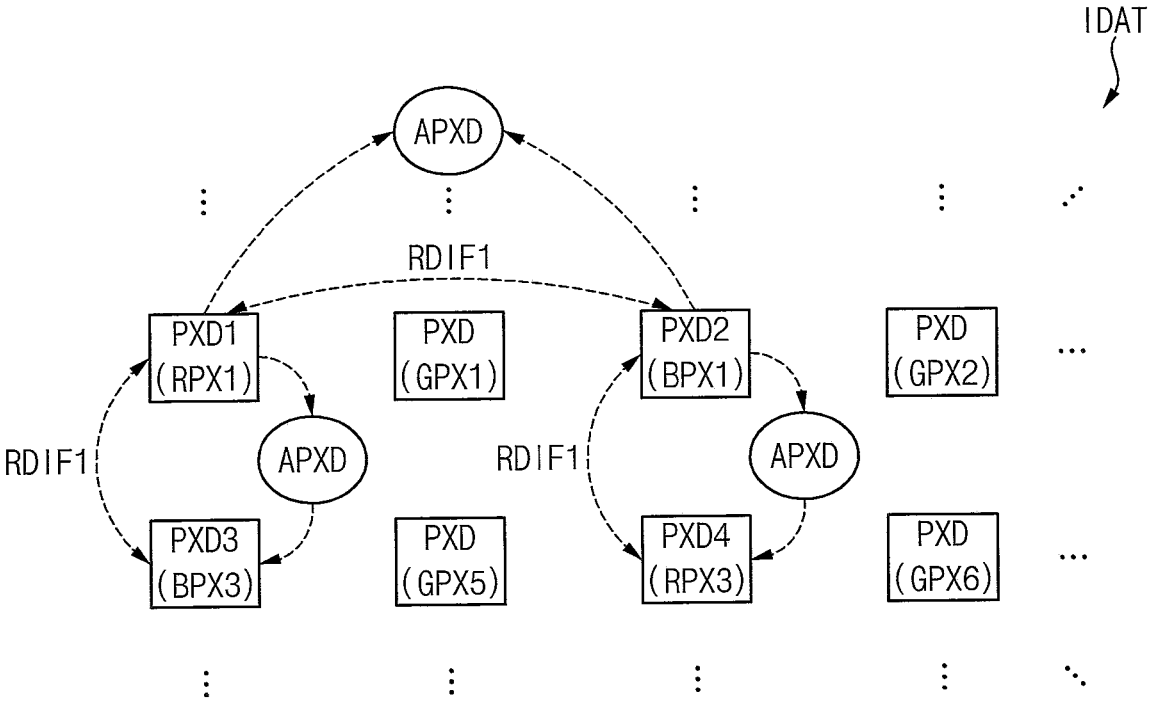
FIG. 8 is a diagram for describing an example of a difference condition, a first increase/decrease condition and a second increase/decrease condition.
Figure 9:
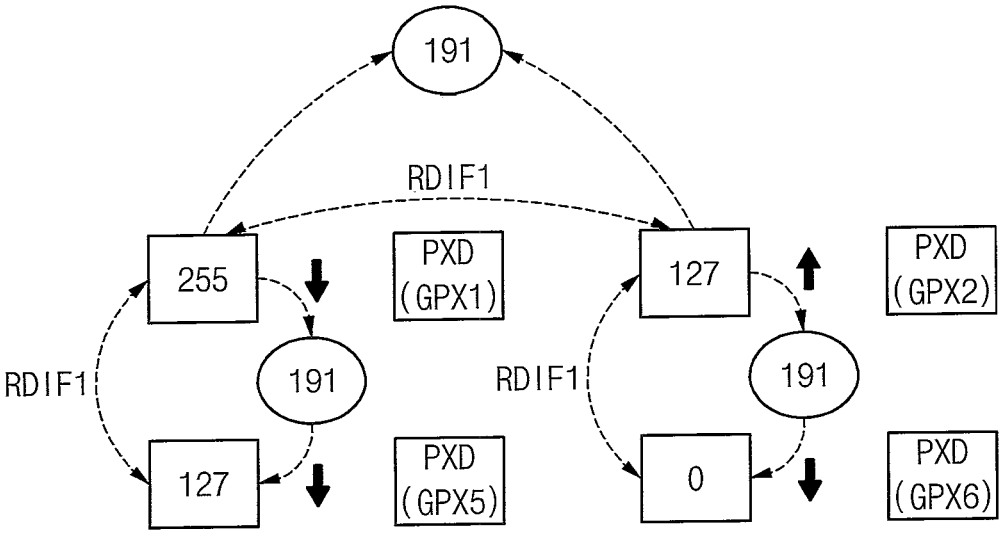
FIG. 9 is a diagram illustrating an example of pixel data by which a charge sharing operation is not performed.
Figure 10A:
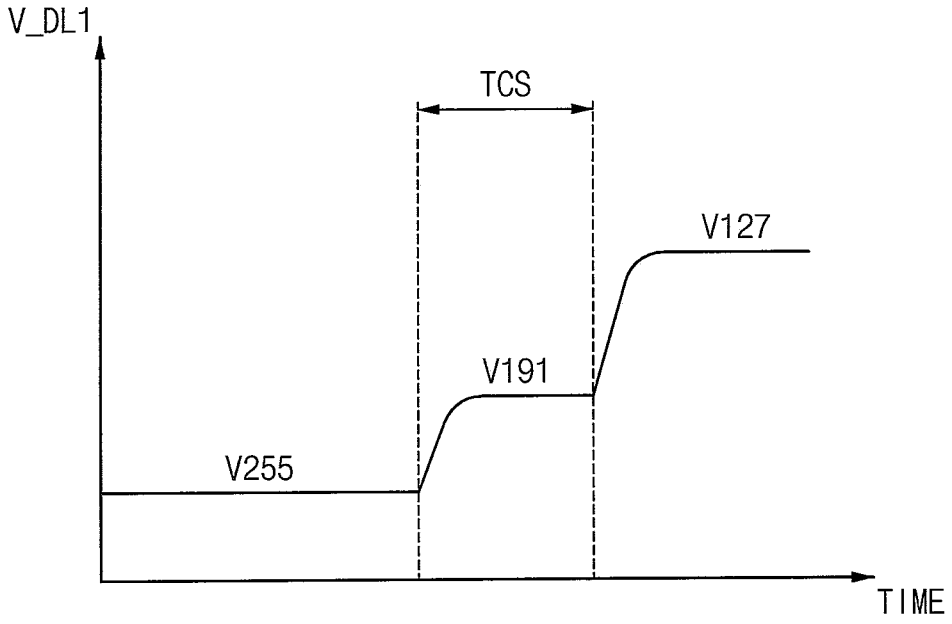
FIG. 10A is a diagram illustrating an example of a voltage of a first data line according to an example of FIG. 9.
Figure 10B:
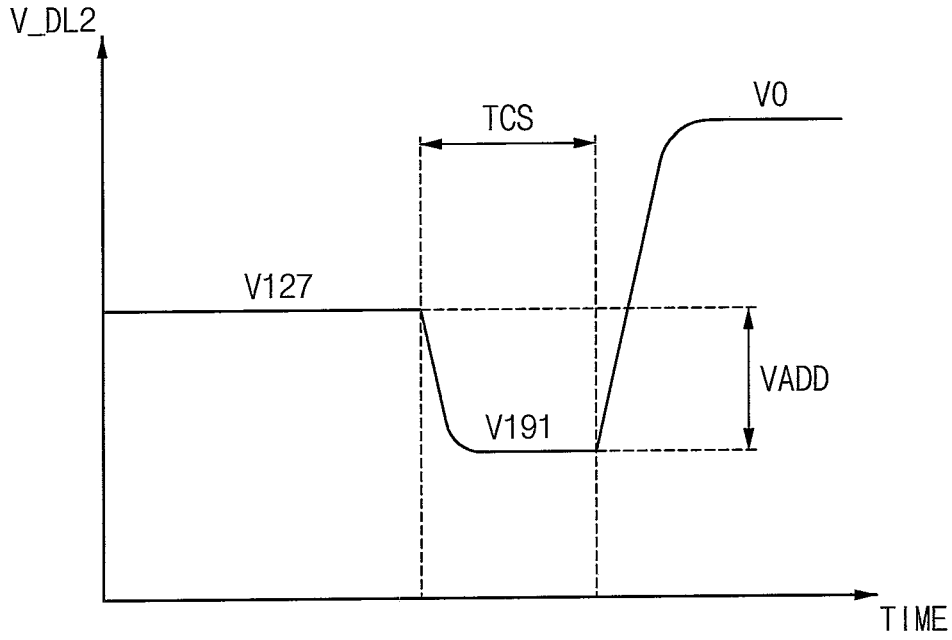
FIG. 10B is a diagram illustrating an example of a voltage of a second data line according to the example of FIG. 9.
Figure 11:
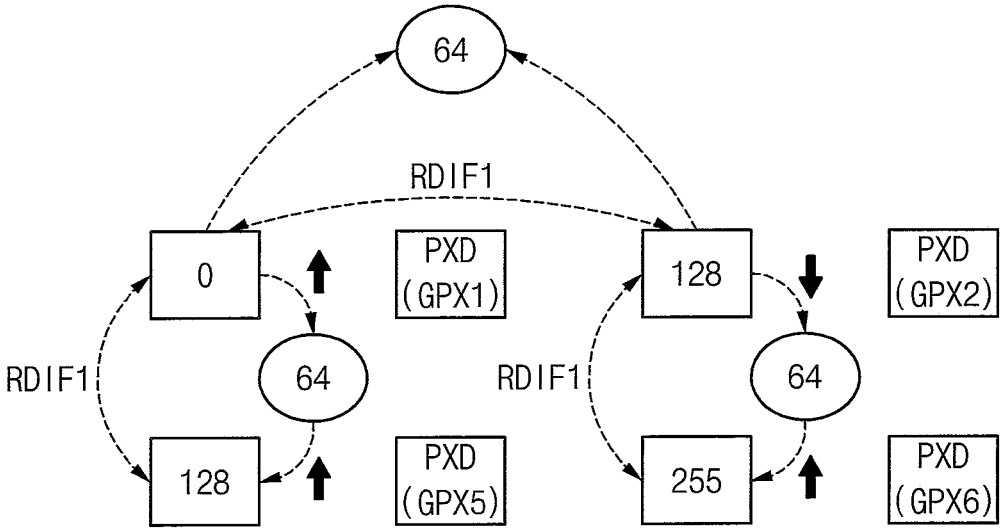
FIG. 11 is a diagram illustrating an example of pixel data by which a charge sharing operation is performed.
Figure 12A:
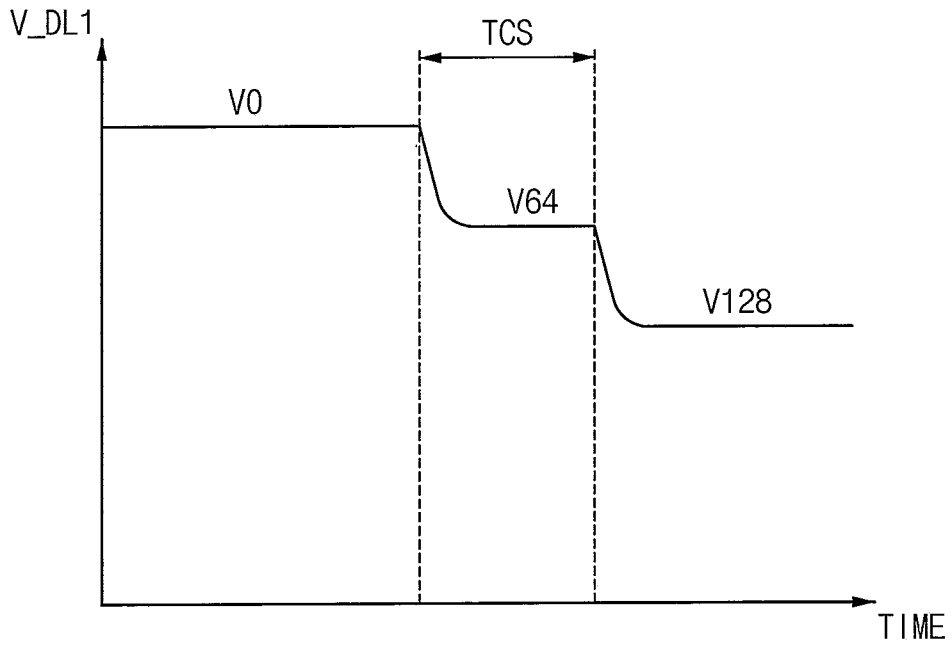
FIG. 12A is a diagram illustrating an example of a voltage of a first data line according to an example of FIG. 11.
Figure 12B:
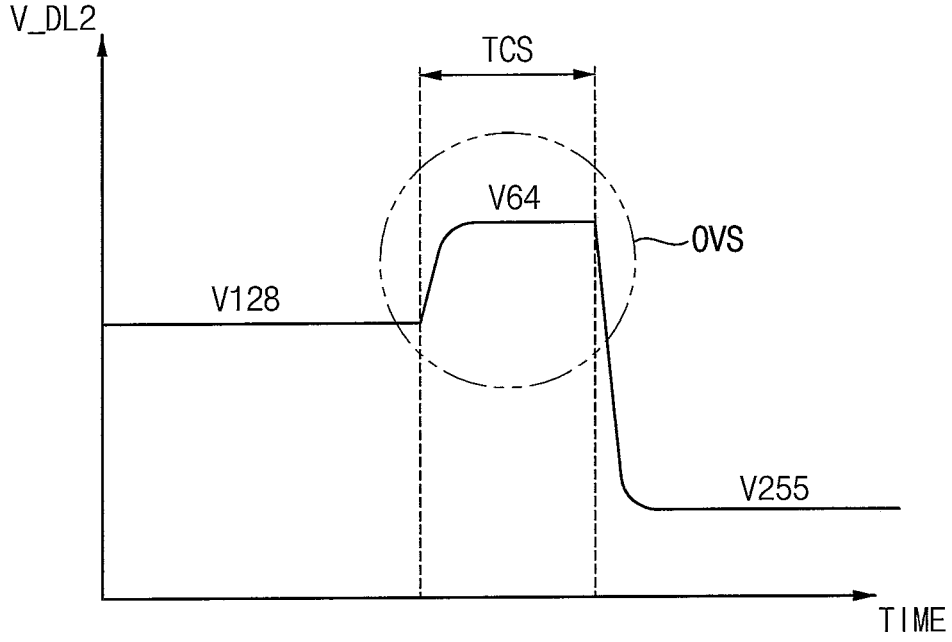
FIG. 12B is a diagram illustrating an example of a voltage of a second data line according to the example of FIG. 11.

FIG. 7 is a flow chart illustrating a method of performing a charge sharing operation according to example embodiments of the present disclosure, FIG. 8 is a diagram for describing an example of a difference condition, a first increase/decrease condition and a second increase/decrease condition, FIG. 9 is a diagram illustrating an example of pixel data by which a charge sharing operation is not performed, FIG. 10A is a diagram illustrating an example of a voltage of a first data line according to an example of FIG. 9, FIG. 10B is a diagram illustrating an example of a voltage of a second data line according to the example of FIG. 9, FIG. 11 is a diagram illustrating an example of pixel data by which a charge sharing operation is performed, FIG. 12A is a diagram illustrating an example of a voltage of a first data line according to an example of FIG. 11, and FIG. 12B is a diagram illustrating an example of a voltage of a second data line according to the example of FIG. 11.

Referring to FIGS. 4, 7 and 8, the display driver 120*a* may determine a difference condition of whether differences among first, second, third and fourth pixel data PXD1, PXD2, PXD3 and PXD4 for a first pixel RPX1, a second pixel BPX1, a third pixel BPX3 and a fourth pixel RPX3 are greater than or equal to a first reference difference RDIF1 (S210). FIG. 8 illustrates a portion of image data IDAT including the first through fourth pixel data PXD1, PXD2, PXD3 and PXD4 for the first through fourth pixels RPX1, BPX1, BPX3 and RPX3 and pixel data PXD for green pixels GPX1, GPX2, GPX5 and GPX6. In some example embodiments of the present disclosure, the difference condition may be satisfied when all of (1) a first difference between the first pixel data PXD1 and the second pixel data PXD2, (2) a second difference between the first pixel data PXD1 and the third pixel data PXD3, and (3) a third difference between the second pixel data PXD2 and the fourth pixel data PXD4 are greater than or equal to the first reference difference RDIF1, and may not be satisfied when at least one of the first difference, the second difference and the third difference is less than the first reference difference RDIF1. For example, the first reference difference RDIF1 may be, but is not limited to, a 127-gray level, a 64-gray level, a 32-gray level, a 16-gray level, or the like. If the difference condition is not satisfied (S220: NO), the display driver 120*a* may not perform a charge sharing operation between a first data line DL and a second data line DL2 (S260).

As an example, in the case the first reference difference RDIF1 is the 127-gray level, and just one of the first, second and third differences is below the 127-gray level, the difference condition is not satisfied and the charge sharing operation is not performed.

If the difference condition is satisfied (S220: YES), the display driver 120*a* may calculate average data APXD of the first pixel data PXD1 and the second pixel data PXD2 (S230). For example, the average data APXD may represent an average gray level between a gray level of the first pixel data PXD1 and a gray level of the second pixel data PXD2.

The display driver 120*a* may determine a first increase/decrease condition among the first pixel data PXD1, the average data APXD and the third pixel data PXD3 and a second increase/decrease condition among the second pixel data PXD2, the average data APXD and the fourth pixel PXD4 (S240). If at least one of the first increase/decrease condition and the second increase/decrease condition is not satisfied (S250: NO), the display driver 120*a* may not perform the charge sharing operation between the first data line DL1 and the second data line DL2 (S260). Alternatively, if both of the first increase/decrease condition and the second increase/decrease condition are satisfied (S250: YES), the display driver 120*a* may perform the charge sharing operation between the first data line DL1 and the second data line DL2 (S270).

In some example embodiments of the present disclosure, in a case where each of the first through fourth pixels RPX1, BPX1, BPX3 and RPX3 includes a driving transistor PT1 implemented with a PMOS transistor as illustrated in FIG. 5, the first increase/decrease condition may be satisfied (1) when the average data APXD is increased from the first pixel data PXD1 and the third pixel data PXD3 is increased from the average data APXD, (2) when the average data APXD is decreased from the first pixel data PXD1 and the third pixel data PXD3 is decreased from the average data APXD, or (3) when the average data APXD is decreased from the first pixel data PXD1 and the third pixel data PXD3 is increased from the average data APXD, and may not be satisfied (4) when the average data APXD is increased from the first pixel data PXD1 and the third pixel data PXD3 is decreased from the average data APXD. Further, the second increase/decrease condition may be satisfied (1) when the average data APXD is increased from the second pixel data PXD2 and the fourth pixel data PXD4 is increased from the average data APXD, (2) when the average data APXD is decreased from the second pixel data PXD2 and the fourth pixel data PXD4 is decreased from the average data APXD, or (3) when the average data APXD is decreased from the second pixel data PXD2 and the fourth pixel data PXD4 is increased from the average data APXD, and may not be satisfied (4) when the average data APXD is increased from the second pixel data PXD2 and the fourth pixel data PXD4 is decreased from the average data APXD.

For example, as illustrated in FIG. 9, in a case where the first pixel data PXD1 represents a 255-gray level, the second pixel data PXD2 represents a 127-gray level, the third pixel data PXD3 represents a 127-gray level, the fourth pixel data PXD4 represents a 0-gray level, and the first reference difference RDIF1 is a 127-gray level, the first difference between the first pixel data PXD1 and the second pixel data PXD2 may be a 128-gray level greater than the first reference difference RDIF1, the second difference between the first pixel data PXD1 and the third pixel data PXD3 may be a 128-gray level greater than the first reference difference RDIF1, the third difference between the second pixel data PXD2 and the fourth pixel data PXD4 may be a 127-gray level equal to the first reference difference RDIF1, and thus the difference condition may be satisfied. In other words, since each of the first to third differences is greater than or equal to the first reference difference of the 127-gray level, the difference condition is satisfied (S220: YES). Further, the average data APXD of the first pixel data PXD1 and the second pixel data PXD2 may represent a 191-gray level. Since the average data APXD representing the 191-gray level is decreased from the first pixel data PXD1 representing the 255-gray level, and the third pixel data PXD3 representing the 127-gray level is decreased from the average data APXD representing the 191-gray level, the first increase/decrease condition may be satisfied. In other words, since the average data APXD of the 191-gray level is less than the first pixel data PXD1 of the 255-gray level and the third pixel data PXD3 is less than the average pixel data APXD of the 191-gray level, the first increase/decrease condition (2) is satisfied. However, since the average data APXD representing the 191-gray level is increased from the second pixel data PXD2 representing the 127-gray level, and the fourth pixel data PXD4 representing the 0-gray level is decreased from the average data APXD representing the 191-gray level, the second increase/decrease condition may not be satisfied.

In a case where the charge sharing operation is performed in the example of FIG. 9, as illustrated in FIG. 10A, a 255-gray voltage V255 corresponding to the first pixel data PXD1 may be applied to the first data line DL1, a voltage V_DL1 of the first data line DL1 may be changed to a 191-gray voltage V191 corresponding to the average data APXD by the charge sharing operation without power consumption (or with small power consumption) during a charge sharing time TCS, and then, a 127-gray voltage V127 corresponding to the third pixel data PXD3 may be applied to the first data line DL1. In this case, compared with a case where the voltage V_DL1 of the first data line DL1 is directly changed from the 255-gray voltage V255 corresponding to the first pixel data PXD1 to the 127-gray voltage V127 corresponding to the third pixel data PXD3, a dynamic current of the display driver 120*a* may be reduced in changing the voltage V_DL1 of the first data line DL1 from the 191-gray voltage V191 by the charge sharing operation to the 127-gray voltage V127 corresponding to the third pixel data PXD3. However, as illustrated in FIG. 10B, a 127-gray voltage V127 corresponding to the second pixel data PXD2 may be applied to the second data line DL2, a voltage V_DL2 of the second data line DL2 may be changed to the 191-gray voltage V191 corresponding to the average data APXD by the charge sharing operation during the charge sharing time TCS, and then a 0-gray voltage VO corresponding to the fourth pixel data PXD4 may be applied to the second data line DL2. In this case, compared with a case where the voltage V_DL2 of the second data line DL2 is directly changed from the 191-gray voltage V191 corresponding to the second pixel data PXD2 to the 0-gray voltage VO corresponding to the fourth pixel data PXD4, the display driver 120*a* should further increase the voltage V_DL2 of the second data line DL2 by an additional voltage VADD corresponding to a difference between the 127-gray voltage V127 and the 191-gray voltage V191, and thus, the dynamic current of the display driver 120*a* may be undesirably increased in changing the voltage V_DL2 of the second data line DL2 from the 191-gray voltage V191 by the charge sharing operation to the 0-gray voltage VO corresponding to the fourth pixel data PXD4. However, in a display device according to example embodiments of the present disclosure, since the second increase/decrease condition is not satisfied, the charge sharing operation may not be performed, and thus, the undesirable increase of the dynamic current and power consumption may be prevented. It is to be understood that the second increase/decrease condition is not satisfied in this case because average data APXD (191) is increased from the second pixel data PXD2 (127) and the fourth pixel data PXD4 (0) is decreased from the average data APXD (191).

In another example, as illustrated in FIG. 11, in a case where the first pixel data PXD1 represents a 0-gray level, the second pixel data PXD2 represents a 128-gray level, the third pixel data PXD3 represents a 128-gray level, the fourth pixel data PXD4 represents a 255-gray level, and the first reference difference RDIF1 is a 127-gray level, the first difference between the first pixel data PXD1 and the second pixel data PXD2 may be a 128-gray level greater than the first reference difference RDIF1, the second difference between the first pixel data PXD1 and the third pixel data PXD3 may be a 128-gray level greater than the first reference difference RDIF1, the third difference between the second pixel data PXD2 and the fourth pixel data PXD4 may be a 127-gray level equal to the first reference difference RDIF1, and thus, the difference condition may be satisfied. Further, the average data APXD of the first pixel data PXD1 and the second pixel data PXD2 may represent a 64-gray level. Since the average data APXD representing the 64-gray level is increased from the first pixel data PXD1 representing the 0-gray level, and the third pixel data PXD3 representing the 128-gray level is increased from the average data APXD representing the 64-gray level, the first increase/decrease condition may be satisfied. Further, since the average data APXD representing the 64-gray level is decreased from the second pixel data PXD2 representing the 128-gray level, and the fourth pixel data PXD4 represents the 255-gray level is increased from the average data APXD representing the 64-gray level, the second increase/decrease condition may be satisfied.

In a case where the charge sharing operation is performed in the example of FIG. 11, as illustrated in FIG. 12A, a 0-gray voltage VO corresponding to the first pixel data PXD1 may be applied to the first data line DL1, the voltage V_DL1 of the first data line DL1 may be changed to a 64-gray voltage V64 corresponding to the average data APXD by the charge sharing operation without power consumption (or with small power consumption) during the charge sharing time TCS, and then, a 128-gray voltage V128 corresponding to the third pixel data PXD3 may be applied to the first data line DL1. In this case, the power consumption of the display driver 120*a* may be reduced by the charge sharing operation. Further, as illustrated in FIG. 12B, a 128-gray voltage V128 corresponding to the second pixel data PXD2 may be applied to the second data line DL2, the voltage V_DL2 of the second data line DL2 may be changed to the 64-gray voltage V64 corresponding to the average data APXD by the charge sharing operation during the charge sharing time TCS, and then, a 255-gray voltage V255 corresponding to the fourth pixel data PXD4 may be applied to the second data line DL2. In this case, although an overshoot OVS where the voltage V_DL2 of the second data line DL2 is increased between the 128-gray voltage V128 and the 255-gray voltage V255 occurs, since the 255-gray voltage V255 has a voltage level lower than that of the 64-gray voltage V64, the dynamic current of the display driver 120*a* may not be required in changing the voltage V_DL2 of the second data line DL2 from the 64-gray voltage V64 to the 255-gray voltage V255, and thus, the power consumption of the display driver 120*a* may not be increased. Thus, in the display device according to example embodiments of the present disclosure, since the all of the difference condition, the first increase/decrease condition and the second increase/decrease condition are satisfied, the charge sharing operation between the first data line DL1 and the second data line DL2 may be performed, and the power consumption of the display driver 120*a* may be reduced.

In other example embodiments of the present disclosure, in a case where each of the first through fourth pixels RPX1, BPX1, BPX3 and RPX3 includes a driving transistor NT1 implemented with an NMOS transistor as illustrated in FIG. 6, the first increase/decrease condition may be satisfied (1) when the average data APXD is increased from the first pixel data PXD1 and the third pixel data PXD3 is increased from the average data APXD, (2) when the average data APXD is decreased from the first pixel data PXD1 and the third pixel data PXD3 is decreased from the average data APXD, or (3) when the average data APXD is increased from the first pixel data PXD1 and the third pixel data PXD3 is decreased from the average data APXD, and may not be satisfied (4) when the average data APXD is decreased from the first pixel data PXD1 and the third pixel data PXD3 is increased from the average data APXD. Further, the second increase/decrease condition may be satisfied (1) when the average data APXD is increased from the second pixel data PXD2 and the fourth pixel data PXD4 is increased from the average data APXD, (2) when the average data APXD is decreased from the second pixel data PXD2 and the fourth pixel data PXD4 is decreased from the average data APXD, or (3) when the average data APXD is increased from the second pixel data PXD2 and the fourth pixel data PXD4 is decreased from the average data APXD, and may not be satisfied (4) when the average data APXD is decreased from the second pixel data PXD2 and the fourth pixel data PXD4 is increased from the average data APXD.

Although only examples where the charge sharing operation between the first data line DL1 and the second data line DL2 is selectively performed by using a first charge sharing switch CSSW1 according to whether predetermined conditions (e.g., the difference condition, the first increase/decrease condition and the second increase/decrease condition) are satisfied are described above, a charge sharing operation between the first data line DL1 and a third data line DL3 using a second charge sharing switch CSSW2, a charge sharing operation between the second data line DL2 and a fourth data line DL4 using a third charge sharing switch CSSW3, and a charge sharing operation between the third data line DL3 and the fourth data line DL4 using a fourth charge sharing switch CSSW4 also may be selectively and similarly performed according to whether corresponding conditions are satisfied.

Figure 13:
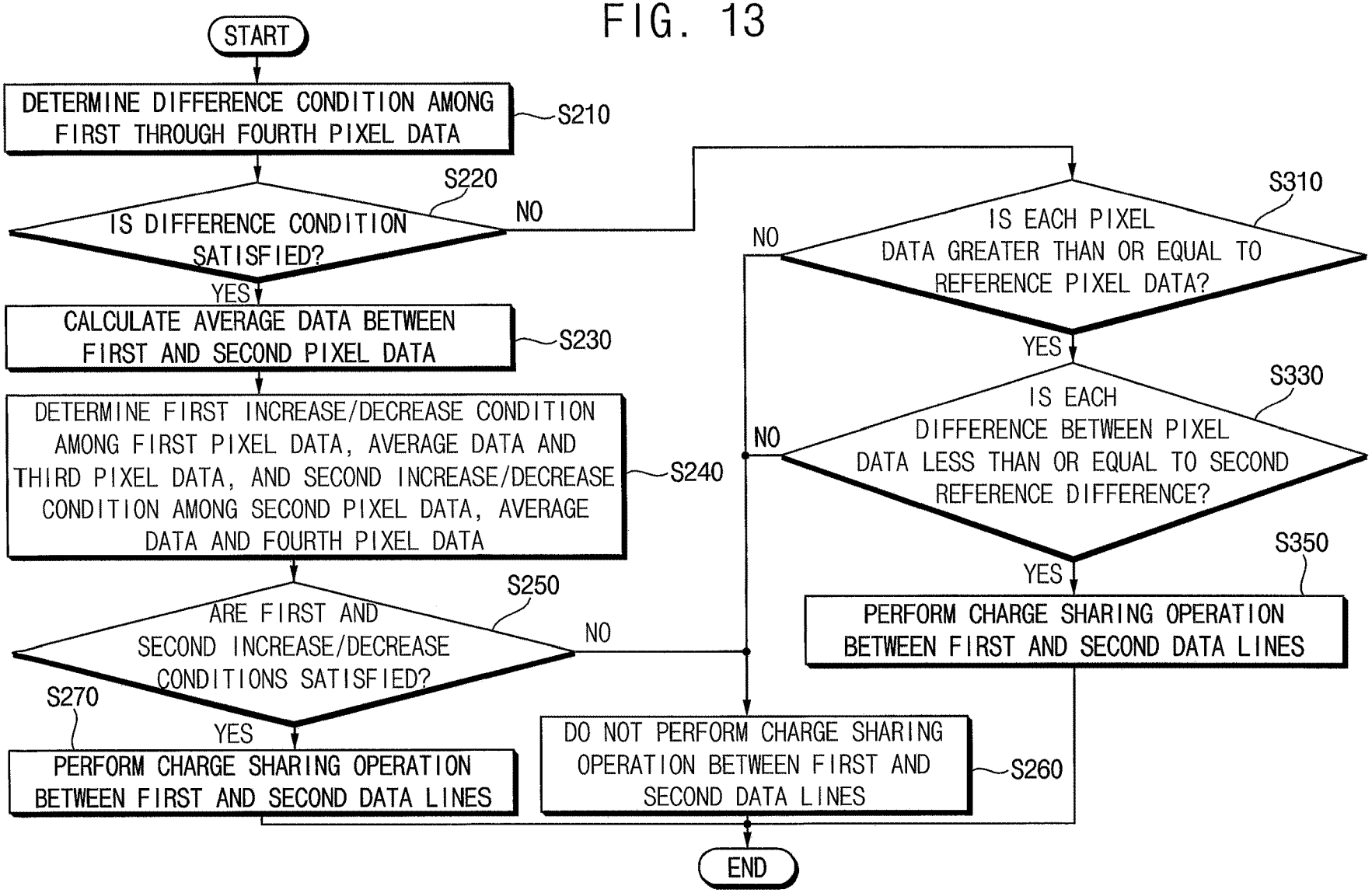
FIG. 13 is a flow chart illustrating a method of performing a charge sharing operation according to example embodiments of the present disclosure.
Figure 14:
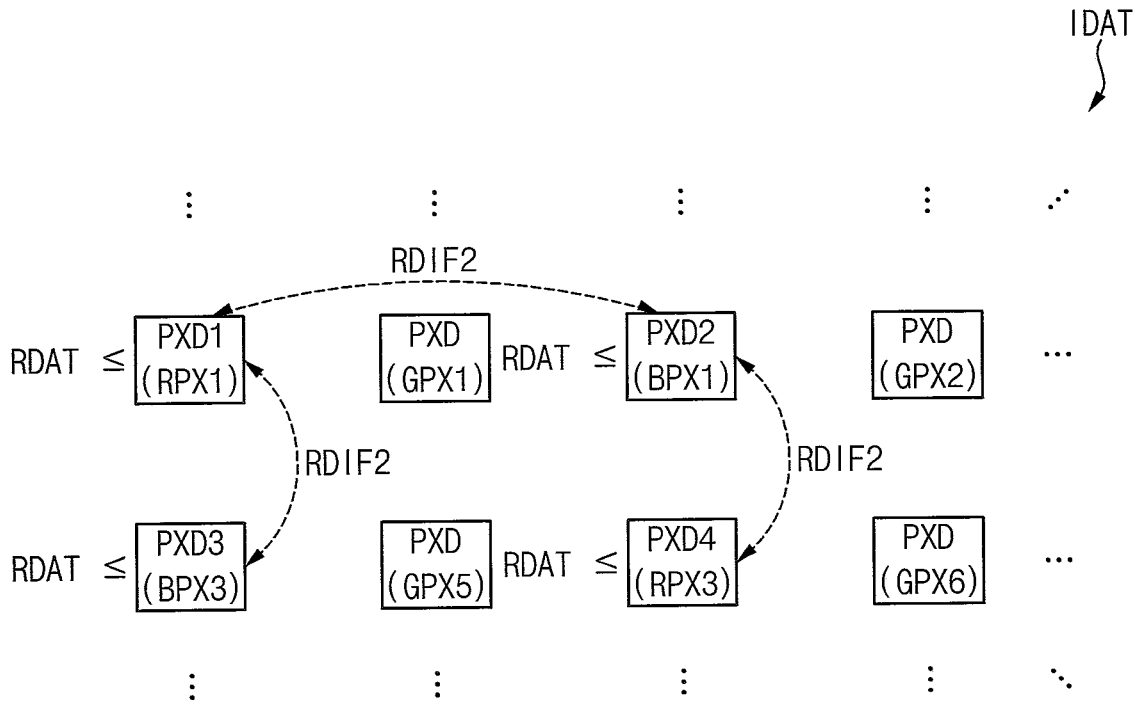
FIG. 14 is a diagram for describing an example of a white pattern condition.

FIG. 13 is a flow chart illustrating a method of performing a charge sharing operation according to example embodiments of the present disclosure, and FIG. 14 is a diagram for describing an example of a white pattern condition.

A method of FIG. 13 may be similar to a method of FIG. 7, except that a charge sharing operation is performed not only when a difference condition, a first increase/decrease condition and a second increase/decrease condition are satisfied, but also when image data represents a white pattern.

Referring to FIGS. 4, 7, 13 and 14, if the difference condition is not satisfied (S220: NO), a display driver 120*a* may determine a white pattern condition of whether first, second, third and fourth pixel data PXD1, PXD2, PXD3 and PXD4 for first, second, third and fourth pixels RPX1, BPX1, BPX3 and RPX3 correspond to the white pattern (S310 and S330).

The display driver 120*a* may determine whether each of the first, second, third and fourth pixel data PXD1, PXD2, PXD3 and PXD4 is greater than or equal to reference data RDAT (S310). For example, the reference data RDAT may represent, but is not limited to, a 200-gray level. In a case where at least one of the first, second, third and fourth pixel data PXD1, PXD2, PXD3 and PXD4 is less than the reference data RDAT (S310: NO), the display driver 120*a* may not perform the charge sharing operation between a first data line DL1 and a second data line DL2 (S260).

In a case where all of the first, second, third and fourth pixel data PXD1, PXD2, PXD3 and PXD4 are greater than or equal to the reference data RDAT (S310: YES), the display driver 120*a* may determine whether each of a first difference between the first pixel data PXD1 and the second pixel data PXD2, a second difference between the first pixel data PXD1 and the third pixel data PXD3, and a third difference between the second pixel data PXD2 and the fourth pixel data PXD4 is less than or equal to a second reference difference RDIF2 (S330). For example, the second reference data RDIF2 may be, but is not limited to, a 20-gray level. In a case where at least one of the first difference, the second difference and the third difference is greater than the second reference difference RDIF2 (S330: NO), the display driver 120*a* may not perform the charge sharing operation between the first data line DL1 and the second data line DL2 (S260). Alternatively, in a case where all of the first difference, the second difference and the third difference are less than or equal to the second reference difference RDIF2 (S330: YES), the display driver 120*a* may perform the charge sharing operation between the first data line DL1 and the second data line DL2 (S350). Accordingly, when the first, second, third and fourth pixels RPX1, BPX1, BPX3 and RPX3 display a white image, the charge sharing operation between the first data line DL1 and the second data line DL2 may be performed, and thus, power consumption of the display driver 120*a* may be reduced.

Figure 15:
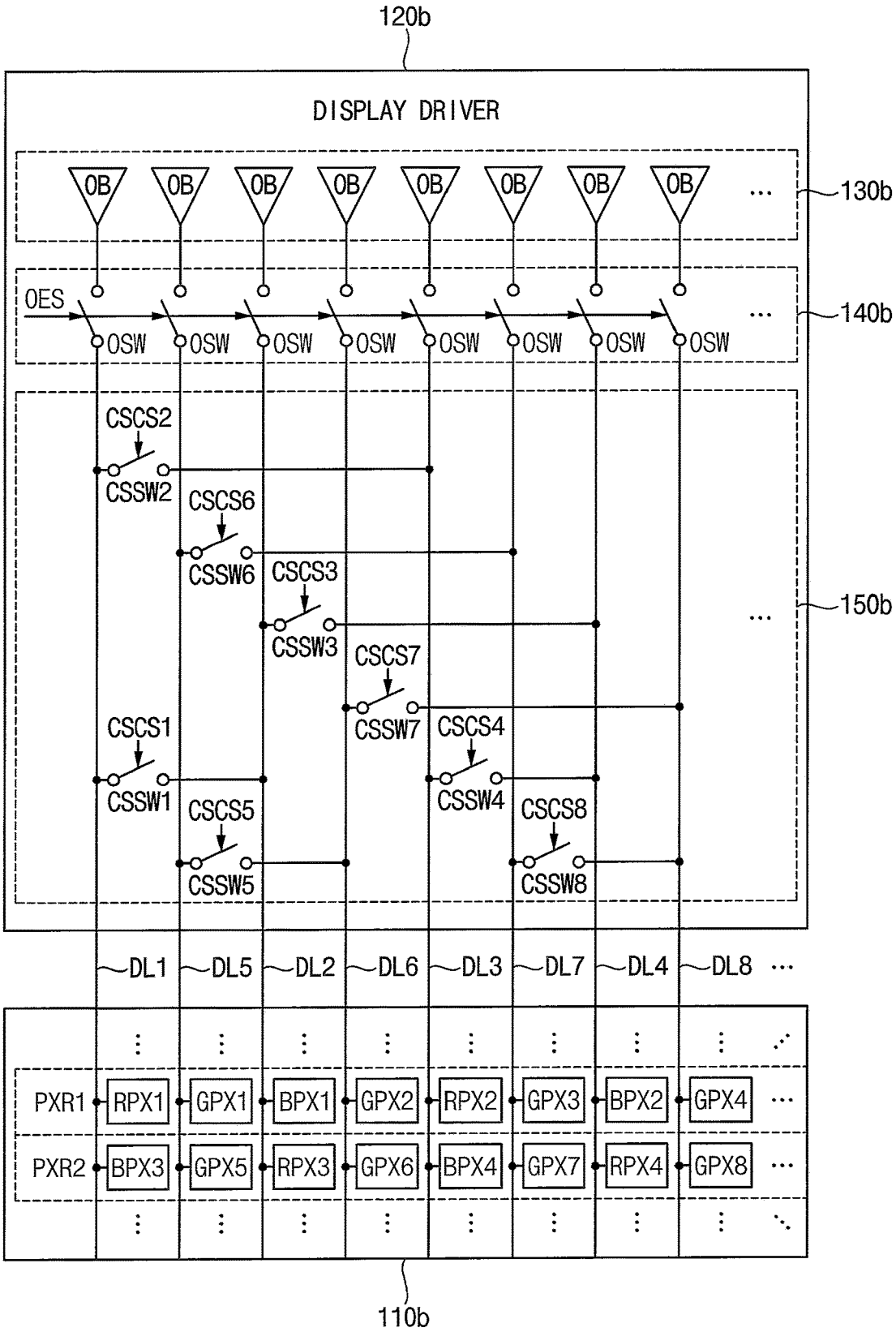
FIG. 15 is a block diagram illustrating a display device including a display panel having an RGBG pixel arrangement structure according to example embodiments of the present disclosure.
Figure 16:
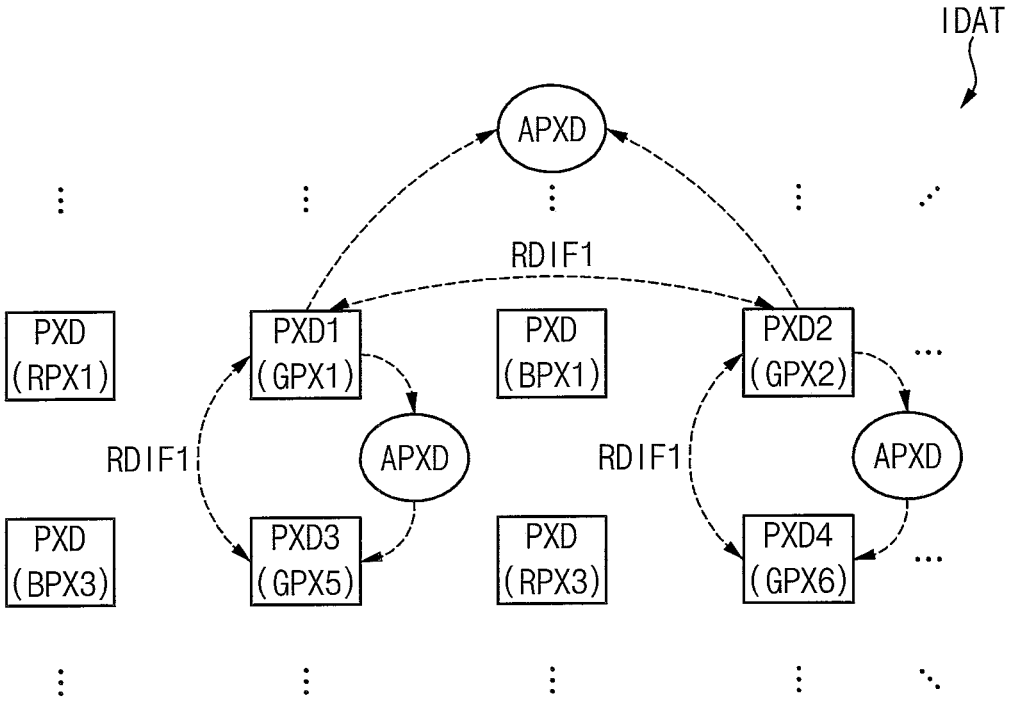
FIG. 16 is a diagram for describing an example of a difference condition, a first increase/decrease condition and a second increase/decrease condition that are determined in a display device of FIG. 15.

FIG. 15 is a block diagram illustrating a display device including a display panel having an RGBG pixel arrangement structure according to example embodiments of the present disclosure, and FIG. 16 is a diagram for describing an example of a difference condition, a first increase/decrease condition and a second increase/decrease condition that are determined in a display device of FIG. 15.

Referring to FIG. 15, similarly to a display panel 110*a* of FIG. 4, a display panel 110*b* may have an RGBG pixel arrangement structure. A display driver 120*b* may include an output buffer circuit 130*b*, an output switch circuit 140*b* and a charge sharing switch circuit 150*b*, and the charge sharing switch circuit 150*b* may further include charge sharing switches CSSW5 through CSSW8 between data lines DL5 through DL8 connected to green pixels GPX1 through GPX8 compared with a charge sharing switch circuit 150*a* illustrated in FIG. 4. For example, the charge sharing switch circuit 150*b* may further include a fifth charge sharing switch CSSW5 that selectively connects a fifth data line DL5 and a sixth data line DL6 in response to a fifth charge sharing control signal CSCS5, a sixth charge sharing switch CSSW6 that selectively connects the fifth data line DL5 and a seventh data line DL7 in response to a sixth charge sharing control signal CSCS6, a seventh charge sharing switch CSSW7 that selectively connects the sixth data line DL6 and an eighth data line DL8 in response to a seventh charge sharing control signal CSCS7, and an eighth charge sharing switch CSSW8 that selectively connects the seventh data line DL7 and the eighth data line DL8 in response to an eighth charge sharing control signal CSCS8.

The display driver 120*b* may perform not only a charge sharing operation between data lines DL1 through DL4 connected to red and blue pixels RPX1 through RPX4 and BPX1 through BPX4, but also a charge sharing operation between the data lines DL5 through DL8 connected to the green pixels GPX1 through GPX8. For example, as illustrated in FIG. 16, in a case where all of a first difference between first pixel data PXD1 for a first green pixel GPX1 and second pixel data PXD2 for a second green pixel GPX2, a second difference between the first pixel data PXD1 for the first green pixel GPX1 and third pixel data PXD3 for a fifth green pixel GPX5, and a third difference between the second pixel data PXD2 for the second green pixel GPX2 and fourth pixel data PXD4 for a sixth green pixel GPX6 are greater than or equal to a first reference difference RDIF1, or in a case where a difference condition is satisfied, the display driver 120*b* may calculate average data APXD of the first pixel data PXD1 and the second pixel data PXD2. Further, in a case where a first increase/decrease condition among the first pixel data PXD1, the average data APXD and the third pixel data PXD3 and a second increase/decrease condition among the second pixel data PXD2, the average data APXD and the fourth pixel data PXD4 are satisfied, the display driver 120*b* may perform the charge sharing operation between the fifth data line DL5 and the sixth data line DL6. Accordingly, power consumption of the display driver 120*b* may be further reduced.

Figure 17:
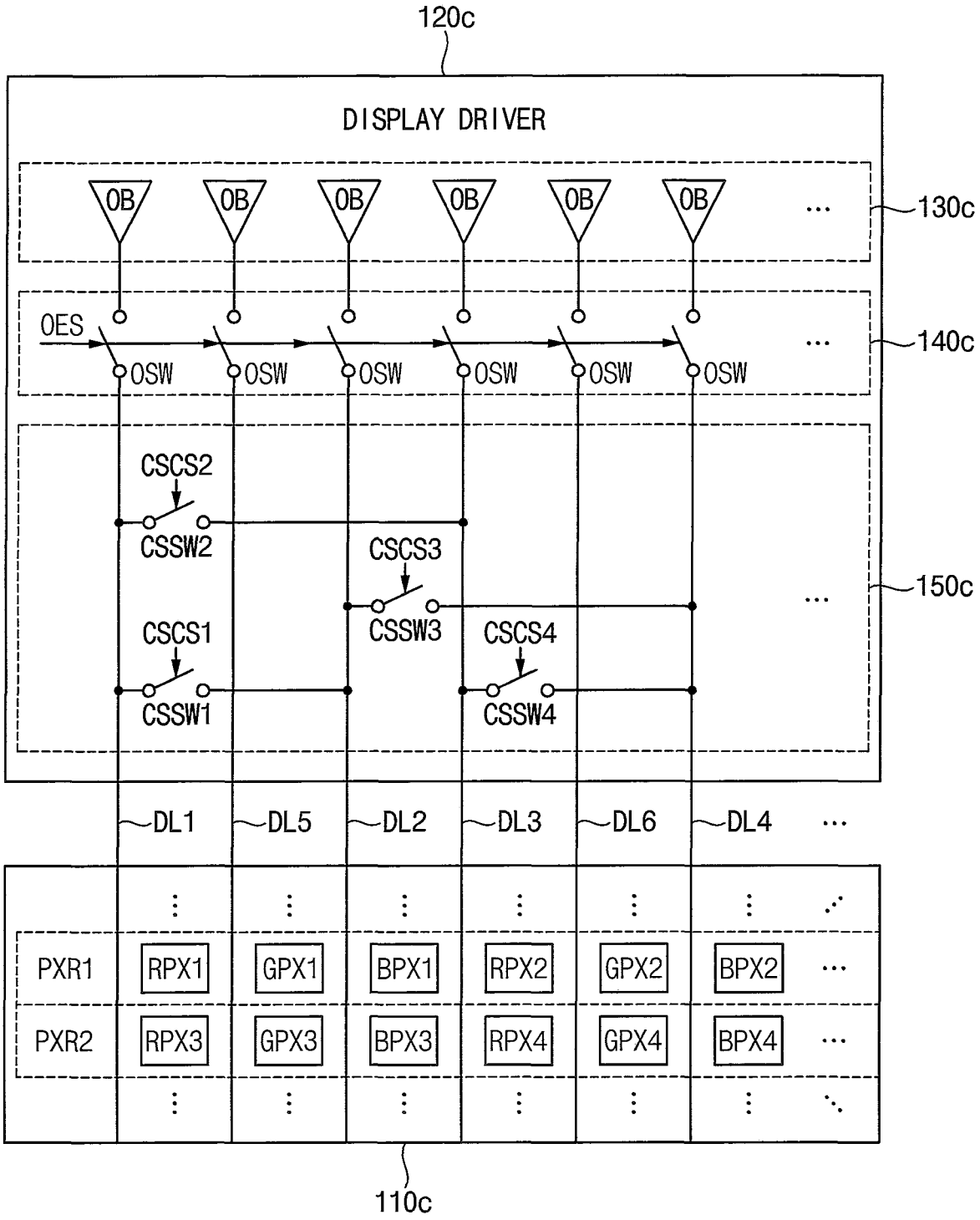
FIG. 17 is a block diagram illustrating a display device including a display panel having an RGB pixel arrangement structure according to example embodiments of the present disclosure.
Figure 18:
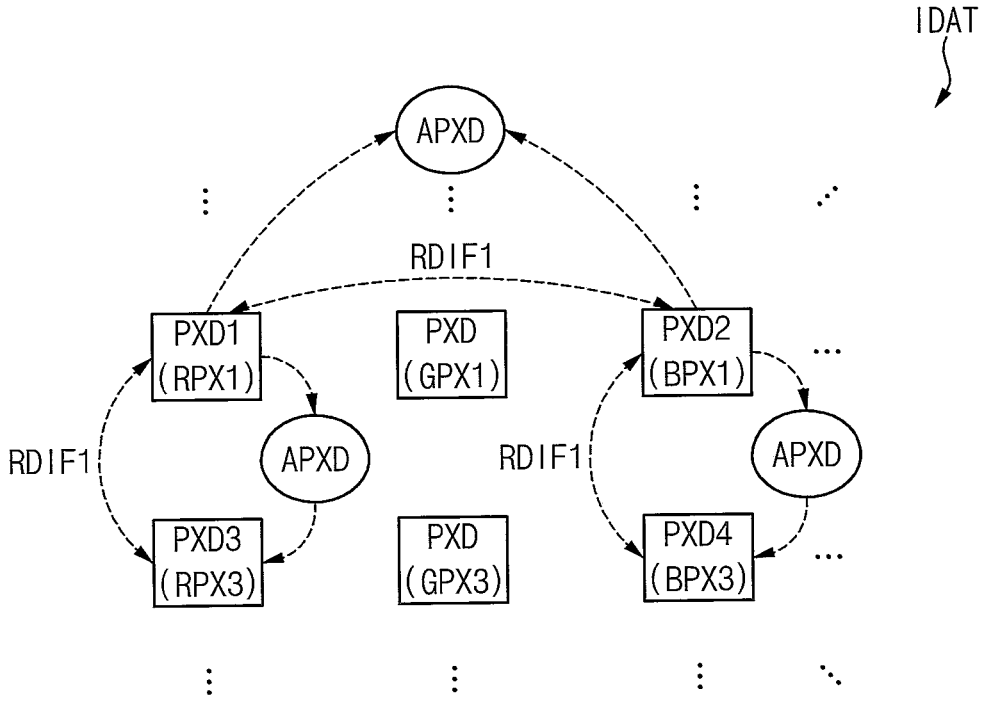
FIG. 18 is a diagram for describing an example of a difference condition, a first increase/decrease condition and a second increase/decrease condition that are determined in a display device of FIG. 17.

FIG. 17 is a block diagram illustrating a display device including a display panel having an RGB pixel arrangement structure according to example embodiments of the present disclosure, and FIG. 18 is a diagram for describing an example of a difference condition, a first increase/decrease condition and a second increase/decrease condition that are determined in a display device of FIG. 17.

Referring to FIG. 17, a display panel 110*c* may have an RGB pixel arrangement structure where a red pixel, a green pixel are a blue pixel are repeatedly arranged in each pixel row. In some embodiments of the present disclosure, the RGB pixel arrangement structure may be referred to as an RGB stripe structure. For example, in the display panel 110*c*, a first red pixel RPX1, a first green pixel GPX1, a first blue pixel BPX1, a second red pixel RPX2, a second green pixel GPX2 and a second blue pixel BPX2 may be repeatedly arranged in a first pixel row PXR1, and a third red pixel RPX3, a third green pixel GPX3, a third blue pixel BPX3, a fourth red pixel RPX4, a fourth green pixel GPX4 and a fourth blue pixel BPX4 may be repeatedly arranged in a second pixel row PXR2.

The display panel 110*c* may include a plurality of data lines DL1 through DL6. For example, the display panel 110*c* may include a first data line DL1 connected to the first red pixel RPX1 and the third red pixel RPX3, a second data line DL2 connected to the first blue pixel BPX1 and the third blue pixel BPX3, a third data line DL3 connected to the second red pixel RPX2 and the fourth red pixel RPX4, a fourth data line DL4 connected to the second blue pixel BPX2 and the fourth blue pixel BPX4, a fifth data line DL5 connected to the first green pixel GPX1 and the third green pixel GPX3, and a sixth data line DL6 connected to the second green pixel GPX2 and the fourth green pixel GPX4.

A display driver 120*c* may include an output buffer circuit 130*c*, an output switch circuit 140*c* and a charge sharing switch circuit 150*c*. The charge sharing switch circuit 150*c* may not include a charge sharing switch between the data lines DL5 and DL6 connected to the green pixels GPX1 through GPX4, and may include charge sharing switches CSSW1 through CSSW4 between the data lines DL1 through DL4 connected to the red and blue pixels RPX1 through RPX4 and BPX1 through BPX4.

The display driver 120*c* may perform a charge sharing operation between the data lines DL1 through DL4 connected to the red and blue pixels RPX1 through RPX4 and BPX1 through BPX4. For example, as illustrated in FIG. 18, in a case where all of a first difference between first pixel data PXD1 for the first red pixel RPX1 and second pixel data PXD2 for a first blue pixel BPX1, a second difference between the first pixel data PXD1 for the first red pixel RPX1 and third pixel data PXD3 for a third red pixel RPX3, and a third difference between the second pixel data PXD2 for the first blue pixel BPX1 and fourth pixel data PXD4 for a third blue pixel BPX3 are greater than or equal to a first reference difference RDIF1, or in a case where a difference condition is satisfied, the display driver 120*c* may calculate average data APXD of the first pixel data PXD1 and the second pixel data PXD2. Further, in a case where a first increase/decrease condition among the first pixel data PXD1, the average data APXD and the third pixel data PXD3 and a second increase/decrease condition among the second pixel data PXD2, the average data APXD and the fourth pixel data PXD4 are satisfied, the display driver 120*c* may perform the charge sharing operation between the first data line DL1 and the second data line DL2. Accordingly, power consumption of the display driver 120*c* may be reduced.

Figure 19:
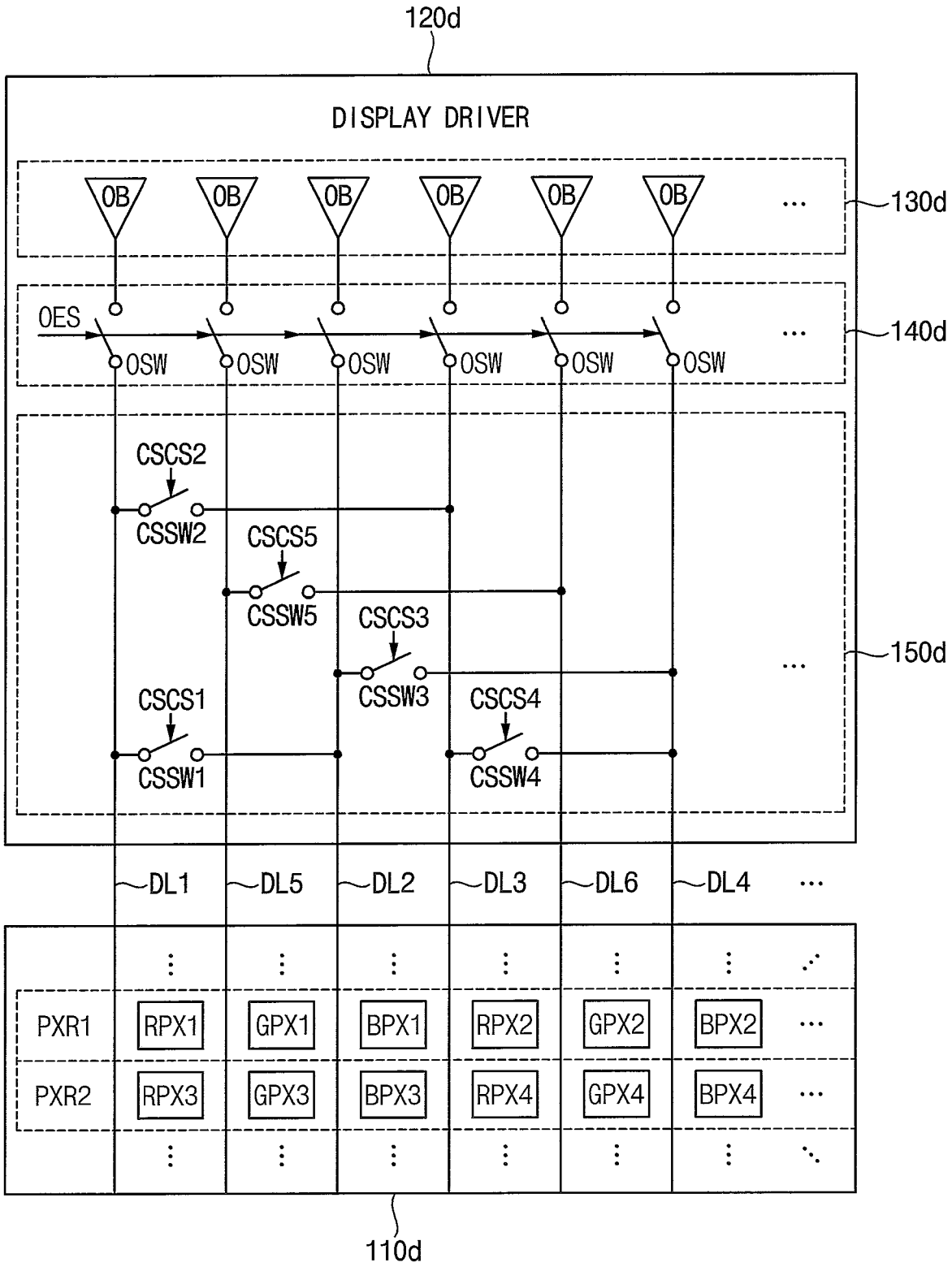
FIG. 19 is a block diagram illustrating a display device including a display panel having an RGB pixel arrangement structure according to example embodiments of the present disclosure.
Figure 20:
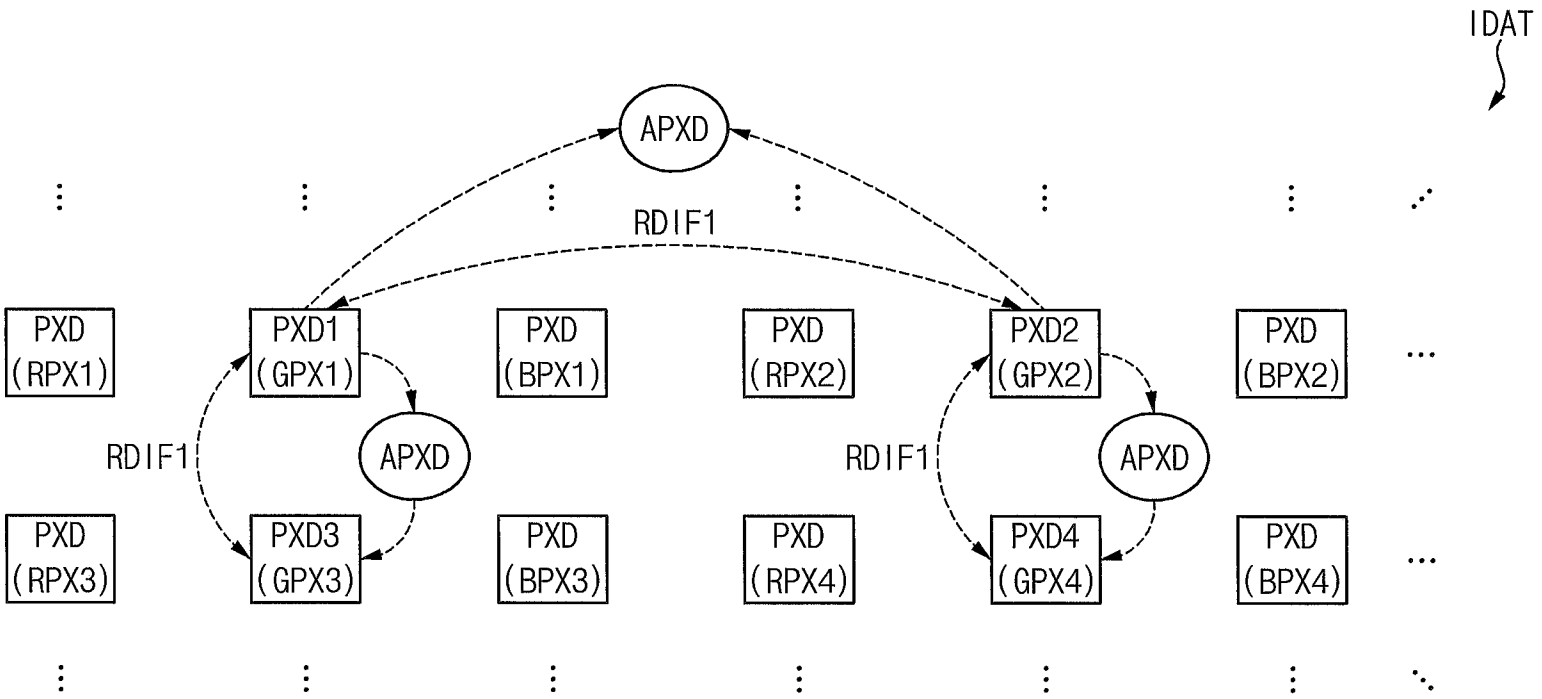
FIG. 20 is a diagram for describing an example of a difference condition, a first increase/decrease condition and a second increase/decrease condition that are determined in a display device of FIG. 19.

FIG. 19 is a block diagram illustrating a display device including a display panel having an RGB pixel arrangement structure according to example embodiments of the present disclosure, and FIG. 20 is a diagram for describing an example of a difference condition, a first increase/decrease condition and a second increase/decrease condition that are determined in a display device of FIG. 19.

Referring to FIG. 19, similarly to a display panel 110*c* of FIG. 17, a display panel 110*d* may have an RGB pixel arrangement structure. A display driver 120*d* may include an output buffer circuit 130*d*, an output switch circuit 140*d* and a charge sharing switch circuit 150*d*, and the charge sharing switch circuit 150*d* may further include a charge sharing switch CSSW5 between data lines DL5 and DL6 connected to green pixels GPX1 through GPX4 compared with a charge sharing switch circuit 150*c* illustrated in FIG. 17. For example, the charge sharing switch circuit 150*d* may further include a fifth charge sharing switch CSSW5 that selectively connects a fifth data line DL5 and a sixth data line DL6 in response to a fifth charge sharing control signal CSCS5.

The display driver 120*d* may perform not only a charge sharing operation between data lines DL1 through DL4 connected to red and blue pixels RPX1 through RPX4 and BPX1 through BPX4, but also a charge sharing operation between the data lines DL5 and DL6 connected to the green pixels GPX1 through GPX4. For example, as illustrated in FIG. 20, in a case where all of a first difference between first pixel data PXD1 for a first green pixel GPX1 and second pixel data PXD2 for a second green pixel GPX2, a second difference between the first pixel data PXD1 for the first green pixel GPX1 and third pixel data PXD3 for a third green pixel GPX3, and a third difference between the second pixel data PXD2 for the second green pixel GPX2 and fourth pixel data PXD4 for a fourth green pixel GPX4 are greater than or equal to a first reference difference RDIF1, or in a case where a difference condition is satisfied, the display driver 120*d* may calculate average data APXD of the first pixel data PXD1 and the second pixel data PXD2. Further, in a case where a first increase/decrease condition among the first pixel data PXD1, the average data APXD and the third pixel data PXD3 and a second increase/decrease condition among the second pixel data PXD2, the average data APXD and the fourth pixel data PXD4 are satisfied, the display driver 120*d* may perform the charge sharing operation between the fifth data line DL5 and the sixth data line DL6. Accordingly, power consumption of the display driver 120*d* may be further reduced.

Figure 21:
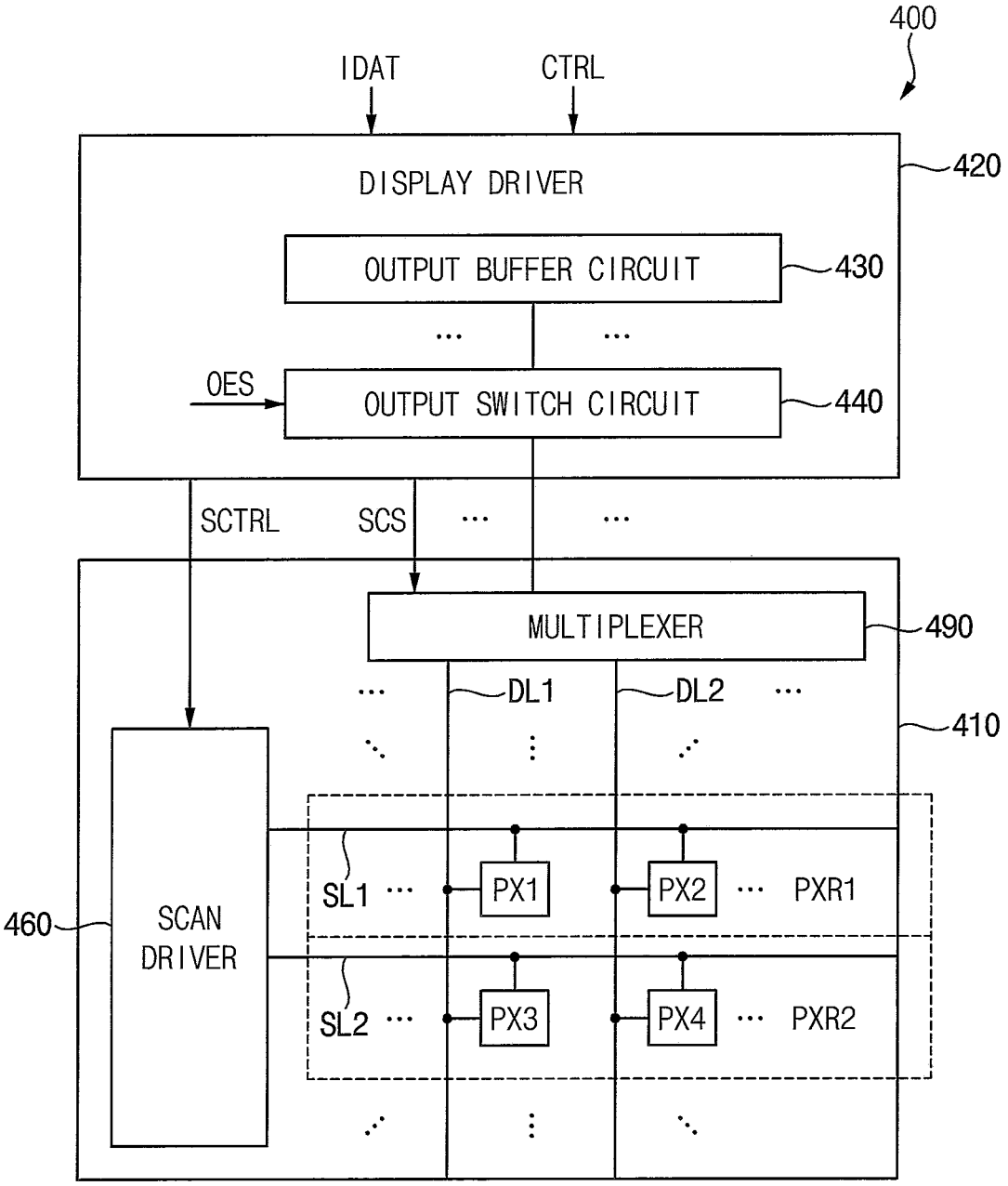
FIG. 21 is a block diagram illustrating a display device according to example embodiments of the present disclosure.

FIG. 21 is a block diagram illustrating a display device according to example embodiments of the present disclosure.

Referring to FIG. 21, a display device 400 may include a display panel 410, a display driver 420, a scan driver 460 and a multiplexer 490. The display driver 420 may include an output buffer circuit 430 and an output switch circuit 440. The display device 400 of FIG. 21 may have a similar configuration and a similar operation to a display device 100 of FIG. 1, except that the display driver 420 may not include a charge sharing switch circuit, and the display device 400 may further include the multiplexer 490 formed on the display panel 410.

The multiplexer 490 may receive a switch control signal SCS from the display driver 420, and may selectively connect the output buffer circuit 430 to a first data line DL1 or a second data line DL2 in response to the switch control signal SCS.

The display driver 420 may calculate average data of first pixel data for a first pixel PX1 and second pixel data for a second pixel PX2, and may selectively perform a charge sharing operation between the first data line DL1 and the second data line DL2 by using the multiplexer 490 according to whether a first increase/decrease condition among the first pixel data, the average data and third pixel data for a third pixel PX3 and a second increase/decrease condition among the second pixel data, the average data and fourth pixel data for a fourth pixel PX4 are satisfied. Accordingly, the charge sharing operation may be efficiently performed.

Figure 22:
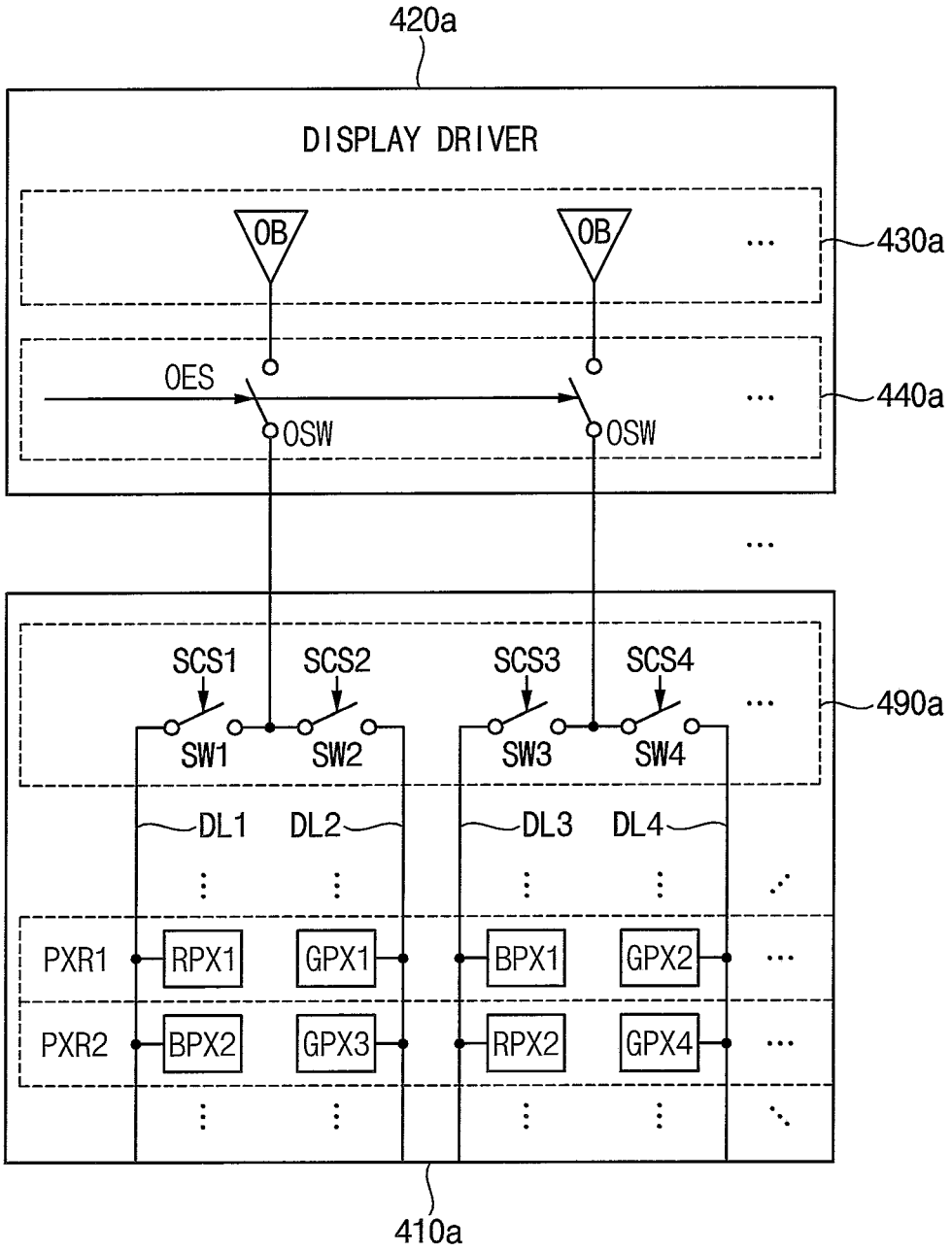
FIG. 22 is a block diagram illustrating a display device that performs a charge sharing operation by using a multiplexer according to example embodiments of the present disclosure.
Figure 23:
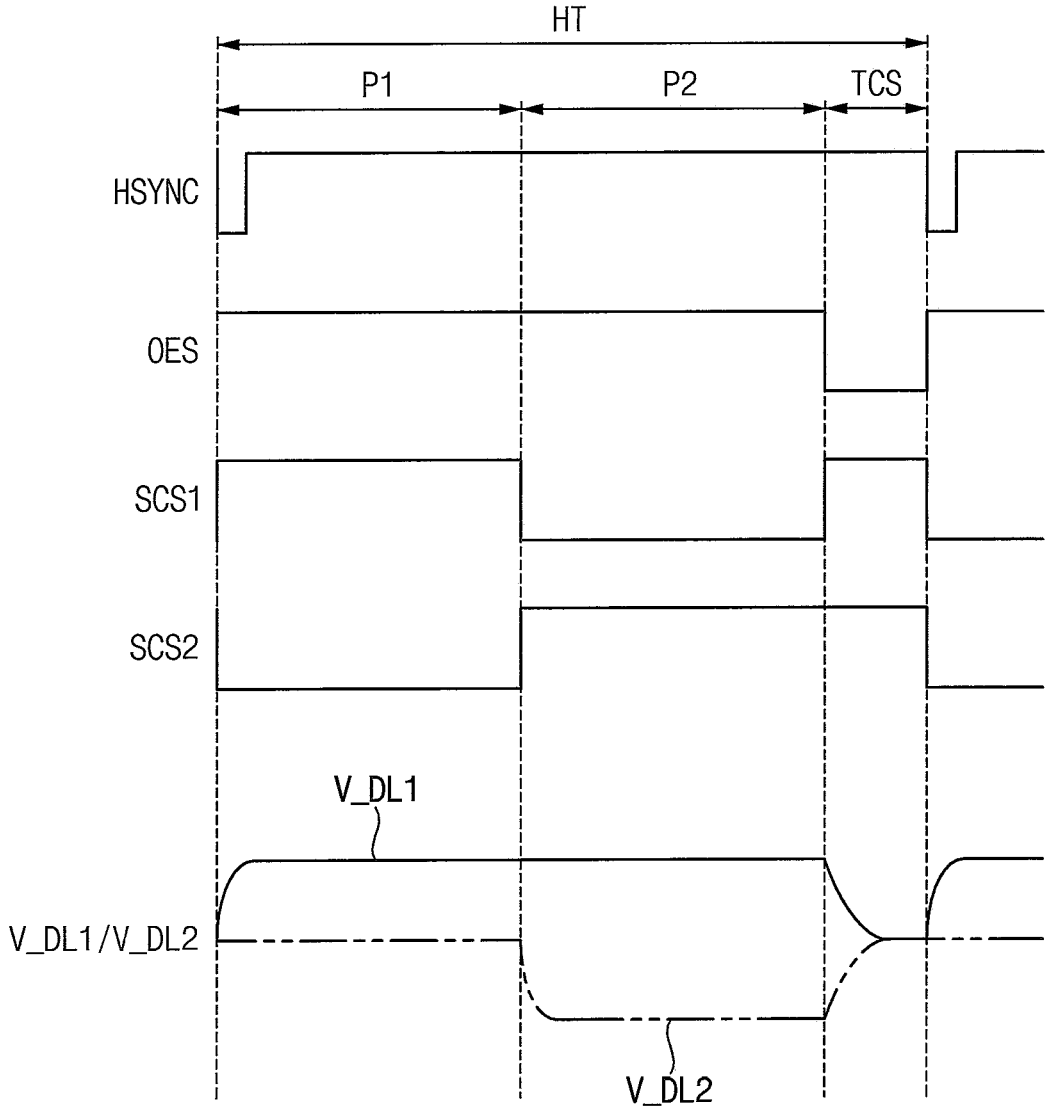
FIG. 23 is a timing diagram for describing an example of a charge sharing operation performed by a display device according to example embodiments of the present disclosure.

FIG. 22 is a block diagram illustrating a display device that performs a charge sharing operation by using a multiplexer according to example embodiments of the present disclosure, and FIG. 23 is a timing diagram for describing an example of a charge sharing operation performed by a display device according to example embodiments of the present disclosure.

Referring to FIG. 22, a display panel 410*a* may have an RGBG pixel arrangement structure. For example, in the display panel 410*a*, a first red pixel RPX1, a first green pixel GPX1, a first blue pixel BPX1 and a second green pixel GPX2 may be repeatedly arranged in a first pixel row PXR1, and a second blue pixel BPX2, a third green pixel GPX3, a second red pixel RPX2 and a fourth green pixel GPX4 may be repeatedly arranged in a second pixel row PXR2. The first red pixel RPX1 and the second blue pixel BPX2 may be connected to a first data line DL1, the first green pixel GPX1 and the third green pixel GPX3 may be connected to a second data line DL2, the first blue pixel BPX1 and the second red pixel RPX2 may be connected to a third data line DL3, and the second green pixel GPX2 and the fourth green pixel GPX4 may be connected to a fourth data line DL4. Although FIG. 22 illustrates an example of the display panel 410*a* having the RGBG pixel arrangement structure, a pixel arrangement structure of the display panel 410*a* is not limited to the example of FIG. 22. For example, the display panel 410*a* may have an RGB pixel arrangement structure.

An output buffer circuit 430*a* of a display driver 420*a* may include a plurality of output buffers OB, and an output switch circuit 440*a* of the display driver 420*a* may include a plurality of output switches OSW. In some example embodiments of the present disclosure, as illustrated in FIG. 22, the number of data channels of the display driver 420*a*, or the number of the output buffers OB and the number of the output switches OSW may correspond to, but is not limited to, a half of the number of the data lines DL1 through DL4 of the display panel 410*a*.

A multiplexer 490*a* may selectively connect the output buffer circuit 430*a* to a portion of the data lines DL1 through DL4 or another portion of the data lines DL1 through DL4 in response to switch control signals SCS1 through SCS4. For example, the multiplexer 490*a* may include a first switch SW1 that connects the output buffer OB in a first data channel to the first data line DL1 in response to a first switch control signal SCS1, a second switch SW2 that connects the output buffer OB in the first data channel to the second data line DL2 in response to a second switch control signal SCS2, a third switch SW3 that connects the output buffer OB in a second data channel to the third data line DL3 in response to a third switch control signal SCS3, and a fourth switch SW4 that connects the output buffer OB in the second data channel to the fourth data line DL4 in response to a fourth switch control signal SCS4.

The display driver 420*a* may calculate average data of first pixel data for the first red pixel RPX1 and second pixel data for the first green pixel GPX1, and may perform a charge sharing operation between the first data line DL1 and the second data line DL2 by using the multiplexer 490*a* when a first increase/decrease condition among the first pixel data, the average data and third pixel data for a second blue pixel BPX2 and a second increase/decrease condition among the second pixel data, the average data and fourth pixel data for a third green pixel GPX3 are satisfied. For example, as illustrated in FIG. 23, each horizontal time HT defined by a horizontal synchronization signal HSYNC may include a first period P1 in which each output buffer OB outputs a data voltage to an odd-numbered data line (e.g., the first data line DL1), a second period P2 in which each output buffer OB outputs a data voltage to an even-numbered data line (e.g., the second data line DL2), and a charge sharing time TCS during which the charge sharing operation is performed. The first switch control signal SCS1 may have a high level and the second switch control signal SCS2 may have a low level in the first period P1, the second switch control signal SCS2 may have a high level and the first switch control signal SCS1 may have a low level in the second period P2, and the first and second switch control signals SCS1 and SCS2 may have the high level in the charge sharing time TCS. During the charge sharing time TCS, the output switch circuit 440*a* may disconnect the output buffer circuit 430*a* from the data lines DL1 through DL4 in response to an output enable signal OES having a low level, and the first and second switches SW1 and SW2 may connect the first data line DL1 and the second data line DL2 to each other in response to the first and second switch control signals SCS1 and SCS2 having the high level. Accordingly, the charge sharing operation may be performed by using the multiplexer 490*a*, and power consumption of the display driver 420*a* may be reduced.

Figure 24:
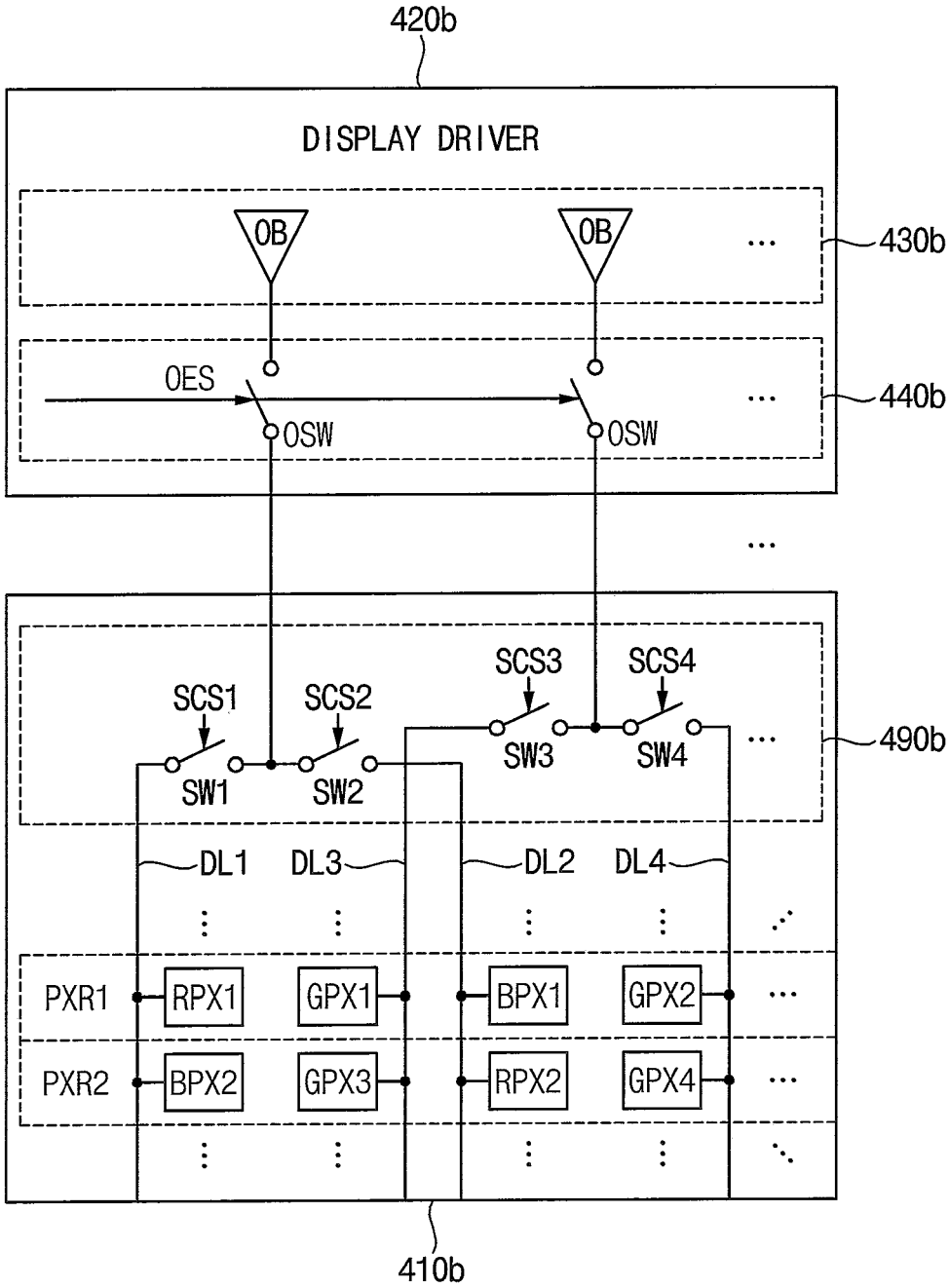
FIG. 24 is a block diagram illustrating a display device that performs a charge sharing operation by using a multiplexer according to example embodiments of the present disclosure.

FIG. 24 is a block diagram illustrating a display device that performs a charge sharing operation by using a multiplexer according to example embodiments of the present disclosure.

Referring to FIG. 24, in a display panel 410*b*, a first red pixel RPX1 and a second blue pixel BPX2 may be connected to a first data line DL1, a first green pixel GPX1 and a third green pixel GPX3 may be connected to a third data line DL3, a first blue pixel BPX1 and a second red pixel RPX2 may be connected to a second data line DL2, and a second green pixel GPX2 and a fourth green pixel GPX4 may be connected to a fourth data line DL4.

A display driver 420*b* may include an output buffer circuit 430*b* and an output switch circuit 440*b*. The display driver 420*b* may perform a charge sharing operation between the first data line DL1 connected to the first red pixel RPX1 and the second blue pixel BPX2 and the second data line DL2 connected to the first blue pixel BPX1 and the second red pixel RPX2 by using first and second switches SW1 and SW2 of a multiplexer 490*b*, and may perform a charge sharing operation between the third data line DL3 connected to the first green pixel GPX1 and the third green pixel GPX3 and the fourth data line DL4 connected to the second green pixel GPX2 and the fourth green pixel GPX4 by using third and fourth switches SW3 and SW4 of the multiplexer 490*b*.

Figure 25:
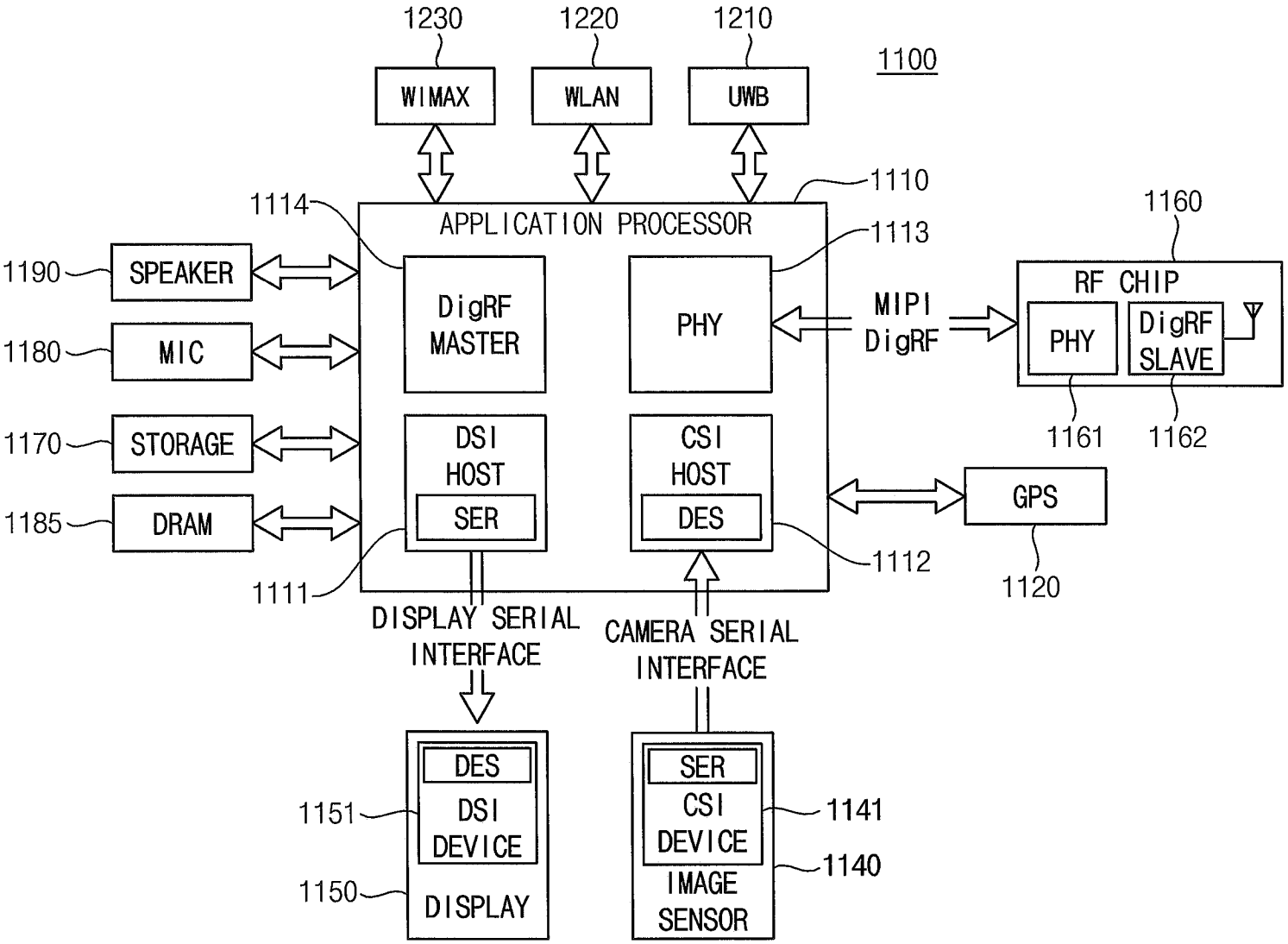
FIG. 25 is a block diagram illustrating a computing system including a display device according to example embodiments of the present disclosure.

FIG. 25 is a block diagram illustrating a computing system including a display device according to example embodiments of the present disclosure.

Referring to FIG. 25, a computing system 1100 may employ or support a MIPI interface, and may include an application processor 1110, an image sensor 1140 and a display device 1150. A CSI host 1112 of the application processor 1110 may perform a serial communication with a CSI device 1141 of the image sensor 1140 using a camera serial interface (CSI). In some example embodiments of the present disclosure, the CSI host 1112 may include a deserializer DES, and the CSI device 1141 may include a serializer SER. A DSI host 1111 of the application processor 1110 may perform a serial communication with a DSI device 1151 of the display device 1150 using a display serial interface (DSI). In some example embodiments of the present disclosure, the DSI host 1111 may include a serializer SER, and the DSI device 1151 may include a deserializer DES.

The computing system 1100 may further include a radio frequency (RF) chip 1160, which may include a physical layer PHY 1161 and a DigRF slave 1162. A physical layer PHY 1113 of the application processor 1110 may perform data transfer with the physical layer PHY 1161 of the RF chip 1160 using a MIPI DigRF. The physical layer PHY 1113 of the application processor 1110 may interface (or alternatively communicate) a DigRF MASTER 1114 for controlling the data transfer with the physical layer PHY 1161 of the RF chip 1160.

The computing system 1100 may further include a global positioning system (GPS) 1120, a storage device 1170, a microphone 1180, a dynamic random access memory (DRAM) 1185 and/or a speaker 1190. The computing system 1100 may communicate with external devices using an ultra-wideband (UWB) communication interface 1210, a wireless local area network (WLAN) communication interface 1220, a worldwide interoperability for microwave access (WIMAX) communication interface 1230, or the like. However, the present disclosure is not limited to configurations or interfaces of the computing system 1100 illustrated in FIG. 25.

According to example embodiments of the present disclosure, the display device 1150 may selectively perform a charge sharing operation. As described above, a display driver of the display device 1150 may calculate average data of first pixel data and second pixel data, and may selectively perform the charge sharing operation according to whether a first increase/decrease condition among the first pixel data, the average data and third pixel data and a second increase/decrease condition among the second pixel data, the average data and fourth pixel data are satisfied. Accordingly, in the display device 1150 according to example embodiments of the present disclosure, the charge sharing operation may be performed only in a case where power consumption is reduced by the charge sharing operation. Further, in the display device 1150 according to example embodiments of the present disclosure, the number of the charge sharing operations may be increased.

The present disclosure may be applied to a display device and any electronic devices and systems including the display device. For example, the present disclosure may be applied to systems such as a mobile phone, a smart phone, a personal digital assistant (PDA), a portable multimedia player (PMP), a digital camera, a camcorder, a personal computer (PC), a server computer, a workstation, a laptop computer, a digital TV, a set-top box, a portable game console, a navigation system, a wearable device, an internet of things (IoT) device, an internet of everything (IoE) device, an c-book, a virtual reality (VR) device, an augmented reality (AR) device, a vehicle navigation system, a video phone, a monitoring system, an auto focusing system, a tracking system, a motion monitoring system, etc.

While the present disclosure has been shown and described with reference to a few example embodiments, those skilled in the art will readily appreciate that many modifications may be made to the disclosed embodiments without departing from scope of the present disclosure as set forth in the claims.

What is claimed is:

1. A display device, comprising:

a display panel including a first data line, a second data line, a first pixel in a first pixel row and connected to the first data line, a second pixel in the first pixel row and connected to the second data line, a third pixel in a second pixel row and connected to the first data line and a fourth pixel in the second pixel row and connected to the second data line, wherein the second pixel row is adjacent to the first pixel row; and a display driver configured to receive image data including first, second, third and fourth pixel data for the first, second, third and fourth pixels, respectively, and to provide first, second, third and fourth data voltages respectively corresponding to the first, second, third and fourth pixel data to the first, second, third and fourth pixels through the first and second data lines, the display driver further configured to:

calculate average data of the first pixel data and the second pixel data; and selectively perform a charge sharing operation between the first data line and the second data line according to whether a first increase/decrease condition among the first pixel data, the average data and the third pixel data and a second increase/decrease condition among the second pixel data, the average data and the fourth pixel data are satisfied, wherein the first increase/decrease condition and the second increase/decrease condition are different from each other.

2. The display device of claim 1, wherein, when the first increase/decrease condition and the second increase/decrease condition are satisfied, the display driver performs the charge sharing operation after outputting the first and second data voltages and before outputting the third and fourth data voltages.

3. The display device of claim 1, wherein each of the first, second, third and fourth pixels includes a driving transistor implemented with a p-type metal-oxide-semiconductor (PMOS) transistor, wherein the first increase/decrease condition is satisfied when the average data is increased from the first pixel data and the third pixel data is increased from the average data, when the average data is decreased from the first pixel data and the third pixel data is decreased from the average data, or when the average data is decreased from the first pixel data and the third pixel data is increased from the average data, and the first increase/decrease condition is not satisfied when the average data is increased from the first pixel data and the third pixel data is decreased from the average data, and wherein the second increase/decrease condition is satisfied when the average data is increased from the second pixel data and the fourth pixel data is increased from the average data, when the average data is decreased from the second pixel data and the fourth pixel data is decreased from the average data, or when the average data is decreased from the second pixel data and the fourth pixel data is increased from the average data, and the second increase/decrease condition is not satisfied when the average data is increased from the second pixel data and the fourth pixel data is decreased from the average data.

4. The display device of claim 1, wherein each of the first, second, third and fourth pixels includes a driving transistor implemented with an n-type metal-oxide-semiconductor (NMOS) transistor, wherein the first increase/decrease condition is satisfied when the average data is increased from the first pixel data and the third pixel data is increased from the average data, when the average data is decreased from the first pixel data and the third pixel data is decreased from the average data, or when the average data is increased from the first pixel data and the third pixel data is decreased from the average data, and the first increase/decrease condition is not satisfied when the average data is decreased from the first pixel data and the third pixel data is increased from the average data, and wherein the second increase/decrease condition is satisfied when the average data is increased from the second pixel data and the fourth pixel data is increased from the average data, when the average data is decreased from the second pixel data and the fourth pixel data is decreased from the average data, or when the average data is increased from the second pixel data and the fourth pixel data is decreased from the average data, and the second increase/decrease condition is not satisfied when the average data is decreased from the second pixel data and the fourth pixel data is increased from the average data.

5. The display device of claim 1, wherein the display driver is further configured to:

determine a difference condition in which differences among the first, second, third and fourth pixel data are greater than or equal to a first reference difference; and perform the charge sharing operation when the difference condition, the first increase/decrease condition and the second increase/decrease condition are satisfied.

6. The display device of claim 5, wherein the difference condition is satisfied when all of a first difference between the first pixel data and the second pixel data, a second difference between the first pixel data and the third pixel data, and a third difference between the second pixel data and the fourth pixel data are greater than or equal to the first reference difference, and wherein the difference condition is not satisfied when at least one of the first difference, the second difference and the third difference is less than the first reference difference.

7. The display device of claim 1, wherein the display driver is further configured to:

determine a white pattern condition in which the first, second, third and fourth pixel data correspond to a white pattern; and perform the charge sharing operation when the first increase/decrease condition and the second increase/decrease condition are satisfied or when the white pattern condition is satisfied.

8. The display device of claim 7, wherein the white pattern condition is satisfied when all of the first, second, third and fourth pixel data are greater than or equal to reference data and all of a first difference between the first pixel data and the second pixel data, a second difference between the first pixel data and the third pixel data, and a third difference between the second pixel data and the fourth pixel data are less than or equal to a second reference difference, and wherein the white pattern condition is not satisfied when at least one of the first, second, third and fourth pixel data is less than the reference data or at least one of the first difference, the second difference and the third difference is greater than the second reference difference.

9. The display device of claim 1, wherein the display driver includes:

an output buffer circuit configured to output the first, second, third and fourth data voltages;

an output switch circuit configured to selectively connect the output buffer circuit to the first and second data lines in response to an output enable signal; and a charge sharing switch circuit configured to selectively connect the first and second data lines to each other in response to a charge sharing control signal.

10. The display device of claim 9, wherein the display driver generates the output enable signal having a low level and the charge sharing control signal having a high level when the first increase/decrease condition and the second increase/decrease condition are satisfied, wherein the output switch circuit disconnects the output buffer circuit from the first and second data lines in response to the output enable signal having the low level, and wherein the charge sharing switch circuit connects the first and second data lines to each other in response to the charge sharing control signal having the high level.

11. The display device of claim 10, wherein a period in which the charge sharing control signal has the high level and a period in which the output enable signal has a high level do not overlap each other.

12. The display device of claim 10, wherein a rising edge of the charge sharing control signal is after a falling edge of the output enable signal, a falling edge of the charge sharing control signal is before a rising edge of the output enable signal.

13. The display device of claim 12, wherein the display driver further includes:

a first time interval register configured to store a first time interval between the rising edge of the charge sharing control signal and the falling edge of the output enable signal; and a second time interval register configured to store a second time interval between the falling edge of the charge sharing control signal and the rising edge of the output enable signal.

14. The display device of claim 1, wherein the display panel has an RGBG pixel arrangement structure where a first red pixel, a first green pixel, a first blue pixel, a second green pixel, a second red pixel, a third green pixel, a second blue pixel and a fourth green pixel are repeatedly arranged in an odd-numbered pixel row, and a third blue pixel, a fifth green pixel, a third red pixel, a sixth green pixel, a fourth blue pixel, a seventh green pixel, a fourth red pixel and an eighth green pixel are repeatedly arranged in an even-numbered pixel row, wherein the first pixel is the first red pixel, the second pixel is the first blue pixel, the third pixel is the third blue pixel, the fourth pixel is the third red pixel, the first data line is connected to the first red pixel and the third blue pixel, and the second data line is connected to the first blue pixel and the third red pixel, wherein the display panel further includes a third data line connected to the second red pixel and the fourth blue pixel, and a fourth data line connected to the second blue pixel and the fourth red pixel, and wherein the display driver includes a charge sharing switch circuit, and the charge sharing switch circuit includes:

a first charge sharing switch configured to selectively connect the first data line and the second data line in response to a first charge sharing control signal;

a second charge sharing switch configured to selectively connect the first data line and the third data line in response to a second charge sharing control signal;

a third charge sharing switch configured to selectively connect the second data line and the fourth data line in response to a third charge sharing control signal; and a fourth charge sharing switch configured to selectively connect the third data line and the fourth data line in response to a fourth charge sharing control signal.

15. The display device of claim 14, wherein the display panel further includes a fifth data line connected to the first green pixel and the fifth green pixel, a sixth data line connected to the second green pixel and the sixth green pixel, a seventh data line connected to the third green pixel and the seventh green pixel, and an eighth data line connected to the fourth green pixel and the eighth green pixel, and wherein the charge sharing switch circuit further includes:

a fifth charge sharing switch configured to selectively connect the fifth data line and the sixth data line in response to a fifth charge sharing control signal;

a sixth charge sharing switch configured to selectively connect the fifth data line and the seventh data line in response to a sixth charge sharing control signal;

a seventh charge sharing switch configured to selectively connect the sixth data line and the eighth data line in response to a seventh charge sharing control signal; and an eighth charge sharing switch configured to selectively connect the seventh data line and the eighth data line in response to an eighth charge sharing control signal.

16. The display device of claim 1, wherein the display panel has an RGB pixel arrangement structure where a first red pixel, a first green pixel, a first blue pixel, a second red pixel, a second green pixel and a second blue pixel are repeatedly arranged in an odd-numbered pixel row, and a third red pixel, a third green pixel, a third blue pixel, a fourth red pixel, a fourth green pixel and a fourth blue pixel are repeatedly arranged in an even-numbered pixel row, wherein the first pixel is the first red pixel, the second pixel is the first blue pixel, the third pixel is the third red pixel, the fourth pixel is the third blue pixel, the first data line is connected to the first red pixel and the third red pixel, and the second data line is connected to the first blue pixel and the third blue pixel, wherein the display panel further includes a third data line connected to the second red pixel and the fourth red pixel, and a fourth data line connected to the second blue pixel and the fourth blue pixel, and wherein the display driver includes a charge sharing switch circuit, and the charge sharing switch circuit includes:

a first charge sharing switch configured to selectively connect the first data line and the second data line in response to a first charge sharing control signal;

a second charge sharing switch configured to selectively connect the first data line and the third data line in response to a second charge sharing control signal;

a third charge sharing switch configured to selectively connect the second data line and the fourth data line in response to a third charge sharing control signal; and a fourth charge sharing switch configured to selectively connect the third data line and the fourth data line in response to a fourth charge sharing control signal.

17. The display device of claim 16, wherein the display panel further includes a fifth data line connected to the first green pixel and the third green pixel, and a sixth data line connected to the second green pixel and the fourth green pixel, and wherein the charge sharing switch circuit further includes:

a fifth charge sharing switch configured to selectively connect the fifth data line and the sixth data line in response to a fifth charge sharing control signal.

18. A display device, comprising:

a display panel including a first data line, a second data line, a first pixel in a first pixel row and connected to the first data line, a second pixel in the first pixel row and connected to the second data line, a third pixel in a second pixel row and connected to the first data line and a fourth pixel in the second pixel row and connected to the second data line, wherein the second pixel row is adjacent to the first pixel row;

a display driver configured to receive image data including first, second, third and fourth pixel data for the first, second, third and fourth pixels, respectively, and including an output buffer circuit configured to provide first, second, third and fourth data voltages respectively corresponding to the first, second, third and fourth pixel data to the first and second data lines; and a multiplexer configured to selectively connect the output buffer circuit to the first data line or the second data line, wherein the display driver is further configured to:

calculate average data of the first pixel data and the second pixel data; and selectively perform a charge sharing operation between the first data line and the second data line by using the multiplexer according to whether a first increase/decrease condition among the first pixel data, the average data and the third pixel data and a second increase/decrease condition among the second pixel data, the average data and the fourth pixel data are satisfied, wherein the first increase/decrease condition and the second increase/decrease condition are different from each other.

19. The display device of claim 18, wherein the multiplexer includes:

a first switch configured to connect the output buffer circuit to the first data line in response to a first switch control signal; and a second switch configured to connect the output buffer circuit to the second data line in response to a second switch control signal, wherein, when the first increase/decrease condition and the second increase/decrease condition are satisfied, the display driver generates the first switch control signal having a high level and the second switch control signal having the high level, and wherein the multiplexer connects the first data line and the second data line in response to the first switch control signal having the high level and the second switch control signal having the high level.

20. A display device, comprising:

a display panel including a first data line, a second data line, a first pixel in a first pixel row and connected to the first data line, a second pixel in the first pixel row and connected to the second data line, a third pixel in a second pixel row and connected to the first data line and a fourth pixel in the second pixel row and connected to the second data line, wherein the second pixel row is adjacent to the first pixel row; and a display driver configured to receive image data including first, second, third and fourth pixel data for the first, second, third and fourth pixels, respectively, and to provide first, second, third and fourth data voltages respectively corresponding to the first, second, third and fourth pixel data to the first, second, third and fourth pixels through the first and second data lines, the display driver including:

an output buffer circuit configured to output the first, second, third and fourth data voltages;

an output switch circuit configured to selectively connect the output buffer circuit to the first and second data lines in response to an output enable signal; and a charge sharing switch circuit configured to selectively connect the first and second data lines to each other in response to a charge sharing control signal, wherein the display driver is further configured to:

determine a difference condition in which differences among the first, second, third and fourth pixel data are greater than or equal to a first reference difference;

calculate average data of the first pixel data and the second pixel data;

determine a first increase/decrease condition among the first pixel data, the average data and the third pixel data and a second increase/decrease condition among the second pixel data, the average data and the fourth pixel data; and perform a charge sharing operation between the first data line and the second data line when the difference condition, the first increase/decrease condition and the second increase/decrease condition are satisfied, wherein the first increase/decrease condition and the second increase/decrease condition are different from each other.

* * * * *